US011289060B2

(12) United States Patent
Takata et al.

(10) Patent No.: US 11,289,060 B2
(45) Date of Patent: Mar. 29, 2022

(54) KEYBOARD DEVICE

(71) Applicant: Roland Corporation, Shizuoka (JP)

(72) Inventors: Yukihide Takata, Shizuoka (JP); Shiro Uno, Shizuoka (JP)

(73) Assignee: Roland Corporation, Shizuoka (JP)

( * ) Notice: Subject to any disclaimer, the term of this patent is extended or adjusted under 35 U.S.C. 154(b) by 0 days.

(21) Appl. No.: 17/055,128

(22) PCT Filed: May 14, 2018

(86) PCT No.: PCT/JP2018/018525
§ 371 (c)(1),
(2) Date: Nov. 13, 2020

(87) PCT Pub. No.: WO2019/220496
PCT Pub. Date: Nov. 21, 2019

(65) Prior Publication Data

US 2021/0217393 A1 Jul. 15, 2021

(51) Int. Cl.
*G10H 1/34* (2006.01)
*G10H 1/18* (2006.01)

(52) U.S. Cl.
CPC ..... *G10H 1/346* (2013.01); *G10H 1/181* (2013.01)

(58) Field of Classification Search
CPC ..... G10H 1/346; G10H 1/181
See application file for complete search history.

(56) References Cited

U.S. PATENT DOCUMENTS

| | | | | |
|---|---|---|---|---|
| 9,281,142 | B2 | 3/2016 | Sawada et al. | |
| 9,966,052 | B2 * | 5/2018 | Vazquez | G10H 1/346 |
| 2021/0217393 | A1 * | 7/2021 | Takata | G10H 1/346 |

FOREIGN PATENT DOCUMENTS

| | | |
|---|---|---|
| JP | S58137893 | 8/1983 |
| JP | H05232937 | 9/1993 |
| JP | 41055172 | 2/1998 |
| JP | 2002006848 | 1/2002 |
| JP | 2014066929 | 4/2014 |

OTHER PUBLICATIONS

"International Search Report (Form PCT/ISA/210) of PCT/JP2018/018525," dated Jul. 31, 2018, with English translation thereof, pp. 1-4.

* cited by examiner

*Primary Examiner* — Robert W Horn
(74) *Attorney, Agent, or Firm* — JCIPRNET

(57) ABSTRACT

A keyboard device is provided including a chassis; a mass body which is turnably installed in the chassis; and transmission means which transmits a driving force in response to key touching of a key to the mass body, wherein the mass body includes an inner wheel and an outer wheel installed on a radially outward side of the inner wheel and is configured to serve as a component for transmitting a torque in one-way direction between the inner wheel and the outer wheel. The transmission means is engaged with one of the inner wheel and the outer wheel of the mass body. The torque is transmitted between the inner wheel and the outer wheel of the mass body at a time of key touching. The torque is not transmitted between the inner wheel and the outer wheel of the mass body at a time of key release.

20 Claims, 9 Drawing Sheets

KEYBOARD DEVICE

CROSS-REFERENCE TO RELATED APPLICATION

This application is a 371 application of the International PCT application serial no. PCT/JP2018/018525, filed on May 14, 2018. The entirety of the above-mentioned patent application is hereby incorporated by reference herein and made a part of this specification.

BACKGROUND

Technical Field

The present disclosure relates to a keyboard device and particularly relates to a keyboard device in which improvement in ease of continuous keying of keys and control of noise can be balanced.

Background Art

In the related art, regarding electronic keyboard instruments such as electric pianos, a technology in which a mass body (for example, a hammer or a flywheel) is interlocked with turning of keys and a key touching feeling is applied due to a load at the time when the mass body is interlocked (turned) is known.

For example, in the technology described in Patent Literature 1, at the time of key touching, a receiving member 350 (a slide surface 52) of a hammer 304 is pressed down by a projection part 334 of a key 3, the hammer 304 turns, and thus a key touching feeling is applied to the key 3. In addition, an engagement piece 334*a* of the projection part 334 is engaged with a guide groove 353*a* of the receiving member 350. Therefore, at the time of key release, separation of the projection part 334 from the slide surface 52 is curbed, and generation of noise caused by the projection part 334 which has landed on (collided with) the slide surface 52 is curbed.

In the technology described in Patent Literature 2, at the time of key touching, a flywheel 1 is turned by an actuator 3 of a key 9, and thus a key touching feeling is applied to the key 9. In this case, the actuator 3 is configured to be separated from the flywheel 1 when the key 9 is touched by a predetermined amount. Therefore, inhibition of returning of the key 9 due to the inertial moment of the flywheel 1 can be curbed, and thus the ease of continuous keying is improved.

CITATION LIST

Patent Literature

[Patent Literature 1]
Japanese Patent Laid-Open No. 2014-066929 (paragraph 00092 and FIGS. 8, 9 and the like)
[Patent Literature 2]
Japanese Patent Laid-Open No. H5-232937 (paragraphs 0011 to 0014 and FIGS. 1, 3, and the like)

SUMMARY

Technical Problem

However, in the foregoing technology described in Patent Literature 1, the hammer 304 cannot return quickly due to the inertial moment at the time of key release, and the key 3 is engaged with the hammer 304 with the engagement piece 334*a* and the guide groove 353*a* therebetween. Therefore, returning of the key 3 is delayed, and the ease of continuous keying deteriorates.

On the other hand, in the foregoing technology described in Patent Literature 2, the actuator 3 is configured to be separated from the flywheel 1. Therefore, when the touched key 9 returns, the actuator 3 abuts the flywheel 1, and thus noise is generated.

That is, in each of the foregoing technologies in the related art, in a structure in which engagement between a key (the key 3 or 9) and a mass body (the hammer 304 or the flywheel 1) is maintained, generation of noise can be curbed, but deterioration in the ease of continuous keying is caused. On the other hand, in a structure in which engagement between a key and a mass body is canceled in the middle of a process, the ease of continuous keying can be improved, but noise is generated when they are engaged with each other again. Thus, there is a problem that improvement in the ease of continuous keying and control of noise cannot be balanced.

The present disclosure has been made in order to resolve the problem described above, and an objective thereof is to provide a keyboard device in which improvement in ease of continuous keying of keys and control of noise can be balanced.

Solution to Problem

In order to achieve the objective thereof, the present disclosure provides a keyboard device including a chassis, keys and a flywheel which are turnably installed in the chassis, and transmission means which transmits a driving force in response to key touching of the keys to the flywheel. The flywheel includes an inner wheel and an outer wheel installed on a radially outward side of the inner wheel and is configured to serve as a one-way clutch for transmitting a torque in one-way direction between the inner wheel and the outer wheel. The transmission means is engaged with one of the inner wheel and the outer wheel of the flywheel. The torque is transmitted between the inner wheel and the outer wheel of the flywheel at a time of key touching. The torque is not transmitted between the inner wheel and the outer wheel of the flywheel at a time of key release.

DESCRIPTION OF THE EMBODIMENTS

Figure 1A:
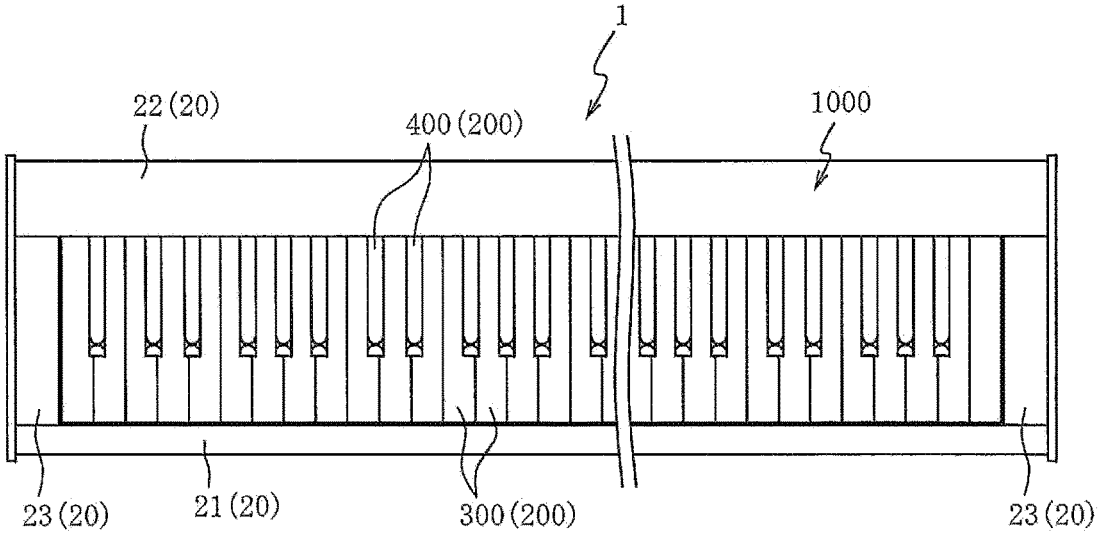
FIG. 1*a* is a top view of a keyboard instrument according to a first embodiment.
Figure 1B:
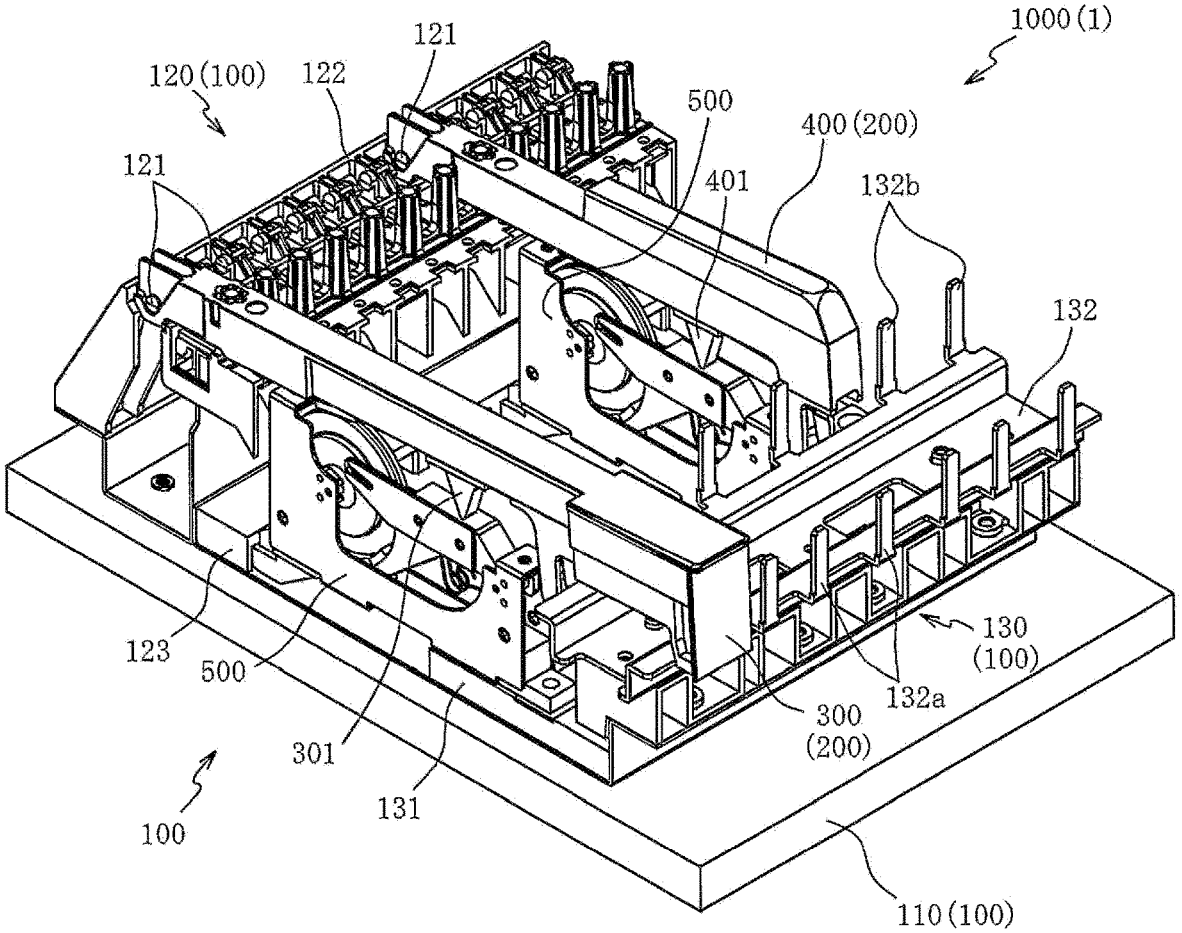
FIG. 1*b* is a perspective view of a keyboard device.

Hereinafter, favorable embodiments will be described with reference to the accompanying drawings. First, with reference to FIGS. 1*a* and 1*b*, schematic configurations of a keyboard instrument 1 according to a first embodiment will be described. FIG. 1*a* is a top view of the keyboard instrument 1 according to the first embodiment, and FIG. 1*b* is a perspective view of a keyboard device 1000. In order to facilitate understanding, in FIG. 1*b*, illustration of a part of the keyboard device 1000 is omitted.

As shown in FIG. 1*a*, the keyboard instrument 1 is an electronic musical instrument (an electric piano) with which a player generates musical sound by operating (playing) a plurality (88 in the present embodiment) of keys 200. The keyboard instrument 1 includes the keyboard device 1000 having the plurality of keys 200, and a panel 20 surrounding parts around the keyboard device 1000.

The keys 200 include a plurality of white keys 300 and black keys 400 arranged side by side in a lateral direction, and parts around the white keys 300 and the black keys 400 are surrounded by the panel 20.

The panel 20 includes a front panel 21, a rear panel 22 which is disposed in a manner of facing the front panel 21 in a forward-rearward direction (upward-downward direction in FIG. 1*a*), and a pair of end panels 23 connecting end parts of the front panel 21 and the rear panel 22 in the lateral direction (lateral direction in FIG. 1*a*) to each other.

For example, a display device which is constituted of an LED, a liquid crystal display, or the like and displays various kinds of states; and a plurality of operation tools which adjusts a volume or changes a mode are installed on an upper surface of the rear panel 22 (none illustrated). In addition, for example, a power source switch, a plurality of jacks for inputting and outputting a MIDI signal or an audio signal, and the like are installed on a rear surface of the rear panel 22 (none illustrated).

As shown in FIG. 1*b*, the keyboard device 1000 includes a chassis 100 which is formed using a synthetic resin, a steel plate, or the like, and a mass body unit 500 which is supported by the chassis 100.

The chassis 100 is a member constituting a skeleton of the keyboard device 1000. The chassis 100 includes a bottom plate 110, a first chassis 120 standing upright on an upper surface of the bottom plate 110 on a rear end side, and a second chassis 130 standing upright on the upper surface of the bottom plate 110 on a side in front of the first chassis 120.

The first chassis 120 is a member for pivotally supporting (supporting) the keys 200 in a turnable manner. The first chassis 120 includes a plurality (88 in the present embodiment) of shaft parts 121 installed on an upper end side thereof and arranged side by side in the lateral direction, and shaft support parts 122 supporting the plurality of shaft parts 121 and extending in the lateral direction.

The shaft parts 121 are formed to have columnar shapes in which shafts are directed in the lateral direction, the keys 200 are pivotably supported by these shaft parts 121, and thus the keys 200 are configured to be able to turn with respect to the first chassis 120.

The second chassis 130 is a member for restricting oscillation of the keys 200 in the lateral direction when the keys 200 (the white keys 300 and the black keys 400) turn. The second chassis 130 includes a base 131 fixed to the upper surface of the bottom plate 110 on a front end and extending in the lateral direction, and a guide part 132 standing upright from an upper surface of the base 131 on the front end side and extending in the lateral direction.

In the guide part 132, a part thereof on the upper end side is formed in a form of sticking out to each of the front side and the rear side, first guide parts 132*a* stand upright in the parts sticking out to the front side, and second guide parts 132*b* stand upright in the parts sticking out to the rear side. The first guide parts 132*a* are guideposts for guiding turning of the white keys 300, and the second guide parts 132*b* are guideposts for guiding turning of the black keys 400.

Each of the plurality of first guide parts 132*a* and the plurality of second guide parts 132*b* is arranged side by side in the lateral direction. Installation positions of the plurality of first guide parts 132*a* and the plurality of second guide parts 132*b* are set at positions corresponding to installation positions of each of the plurality of white keys 300 and the plurality of black keys 400.

The white keys 300 and the black keys 400 are formed using a synthetic resin having an elongated shape extending forward and rearward. The white keys 300 and the black keys 400 are formed to have a box shape of which a lower surface side opens, and the first guide parts 132*a* or the second guide parts 132*b* are slidably inserted into the open portions. Accordingly, a turning operation of the white keys 300 and the black keys 400 is guided by the first guide parts 132*a* or the second guide parts 132*b*.

The white keys 300 and the black keys 400 are pivotably supported by the shaft parts 121 positioned on the upper end side of the first chassis 120. Therefore, a space for installing the mass body unit 500 is formed below the white keys 300 and the black keys 400. The mass body unit 500 is a unit for applying a key touching feeling when the white keys 300 and the black keys 400 are touched.

The white keys 300 and the black keys 400 include projection parts 301 and 401 protruding downward from the lower surfaces thereof, and a driving force is applied to the mass body unit 500 via the projection parts 301 or 401 when the white keys 300 or the black keys 400 are touched. The front end side of the mass body unit 500 is held by a holding member 123 of the first chassis 120, and the rear end side is fixed to the base 131 of the second chassis 130.

Figure 2A:
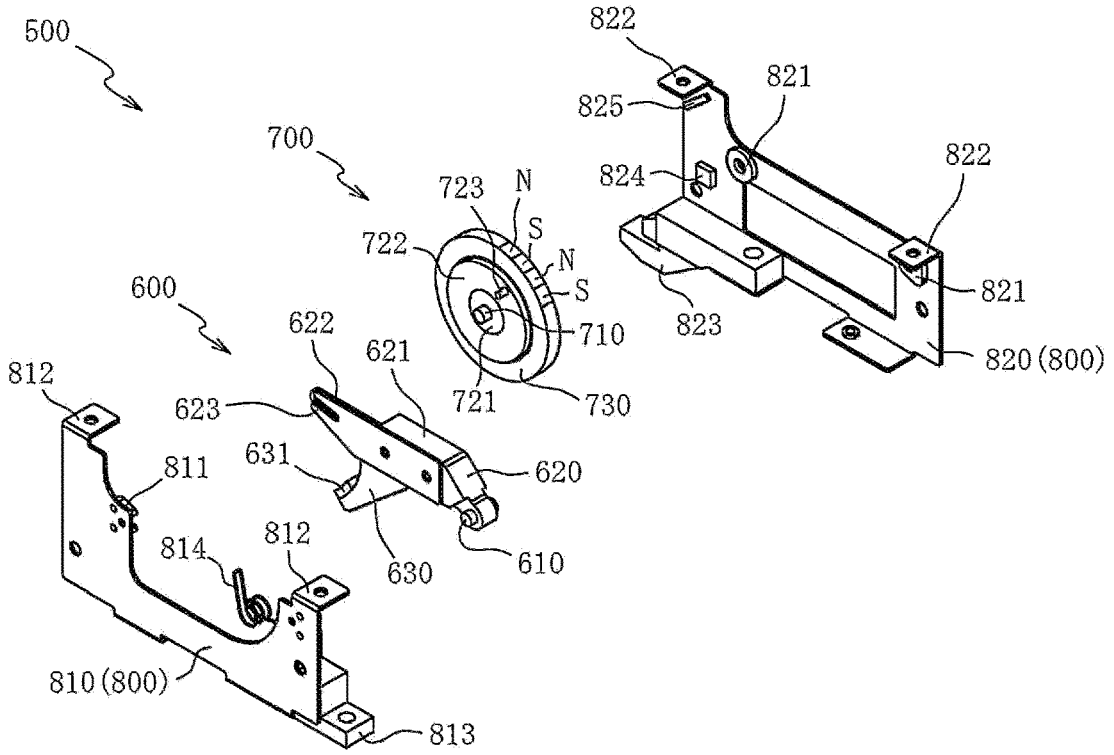
FIG. 2*a* is an exploded perspective view of a mass body unit.
Figure 2B:
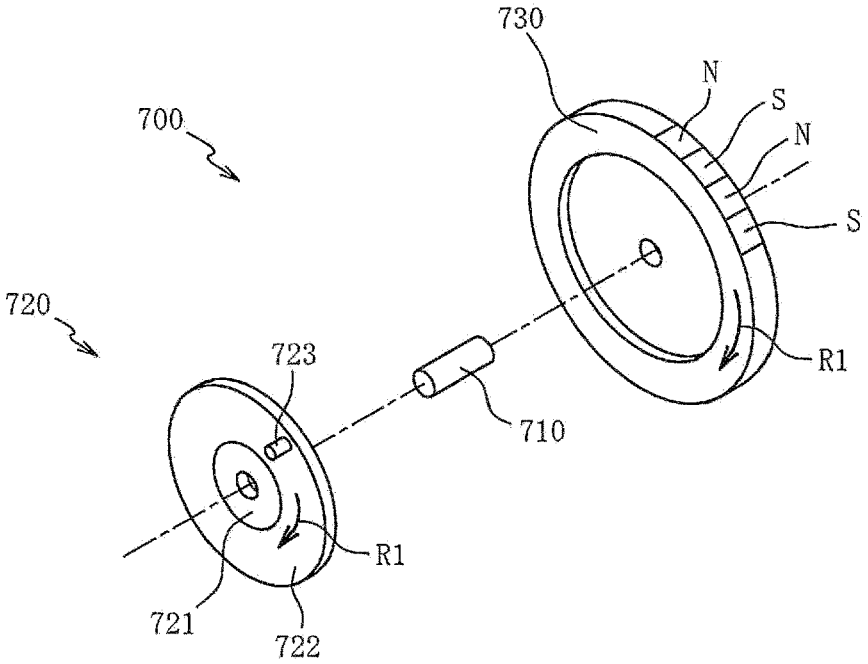
FIG. 2*b* is an exploded perspective view of a flywheel.

Next, with reference to FIGS. 2*a* and 2*b*, a specific configuration of the mass body unit 500 will be described. FIG. 2*a* is an exploded perspective view of the mass body unit 500, and FIG. 2*b* is an exploded perspective view of a flywheel 700.

As shown in FIG. 2*a*, the mass body unit 500 includes a transmission member 600, the flywheel 700 turning due to a driving force transmitted via the transmission member 600, and a case body 800 pivotally supporting (supporting) the transmission member 600 and the flywheel 700 in a turnable manner.

The transmission member 600 is a member for transmitting a driving force generated in response to key touching of the white key 300 to the flywheel 700. The transmission member 600 includes a turning shaft 610, a main body part 620 turning around the turning shaft 610, and a stopper part 630 protruding downward from the lower surface of the main body part 620.

The turning shaft 610 is formed to have a columnar shape in which a shaft is directed in the lateral direction, this turning shaft 610 is supported (pivotally supported) by the case body 800, and thus the main body part 620 is turnably supported by the case body 800. The main body part 620 extends from the turning shaft 610 toward the rear side (in a direction orthogonal to the shaft of the turning shaft 610), and the upper surface of the main body part 620 is a flat surface extending forward and rearward. The flat surface is configured to serve as an abutting surface 621 that the projection parts 301 and 401 (refer to FIGS. 1*a* and 1*b*) of the white keys 300 and the black keys 400 abut.

In addition, the main body part 620 includes an engagement part 622 protruding rearward beyond the abutting surface 621, and the engagement part 622 is engaged with the flywheel 700. In an engagement state thereof, the stopper part 630 is installed in a manner of facing an outer circumferential surface of the flywheel 700 on the lower surface side (below a rotary shaft 710). A cushioning member 631 is bonded to a protruding distal end side (a part facing the flywheel 700) of the stopper part 630, and the cushioning member 631 is formed using a rubber material, felt, or the like.

As shown in FIG. 2*b*, the flywheel 700 is a member for applying a key touching feeling due to a load at the time of turning thereof. The flywheel 700 includes the rotary shaft 710, a disk-shaped clutch part 720 to which one end of the rotary shaft 710 is fixed, and a disk-shaped mass part 730 to which the other end of the rotary shaft 710 is fixed.

The rotary shaft 710 is formed to have a columnar shape in which a shaft is directed in the lateral direction. The rotary shaft 710 is inserted through a penetration hole passing the center of gravity (radial center) of the clutch part 720 and the mass part 730 and is bonded using a bonding agent or the like, and thus the rotary shaft 710, the clutch part 720, and the mass part 730 are configured to be able to rotate integrally.

The clutch part 720 includes an inner wheel 721 in which the rotary shaft 710 is fixed to an inner circumferential side, an outer wheel 722 installed on a radially outward side of the inner wheel 721, and a roller and a spring (not illustrated) interposed between the inner wheel 721 and the outer wheel 722. The clutch part 720 is configured to serve as a one-way clutch transmitting a torque in only one direction (arrow R1 direction) between the inner wheel 721 and the outer wheel 722.

Thus, when the outer wheel 722 rotates in one direction (arrow R1 direction) due to a driving force transmitted to the outer wheel 722 (which will be described below in detail), a torque (a rotation force in the arrow R1 direction) is transmitted to the mass part 730 via the inner wheel 721 and the rotary shaft 710. On the other hand, in the configuration, when the outer wheel 722 rotates in the other direction (to the opposite side in the arrow R1 direction), no torque is transmitted to the mass part 730.

The mass part 730 is a mass body (weight) having a predetermined (to an extent that a key touching feeling can be applied) weight, and thus the magnitude of the inertial moment of the flywheel 700 can be changed by changing the weight of the mass part 730.

The rotary shaft 710 is supported (pivotally supported) by the case body 800, and thus the clutch part 720 and the mass part 730 are turnably supported with respect to the case body 800. A protrusion part 723 protruding toward the engagement part 622 (refer to FIG. 2*a*) of the transmission member 600 in the lateral direction is formed on a side surface of the outer wheel 722.

A groove part 623 having a groove shape is formed in the rear end part of the engagement part 622, and the protrusion part 723 is slidably engaged with (inserted through) the groove part 623. The groove part 623 linearly extends forward and rearward (in a direction in which it is separated from the turning shaft 610), the protrusion part 723 slides along the groove part 623 in accordance with turning of the transmission member 600, and thus the transmission member 600 and the flywheel 700 can be interlocked with each other in the configuration.

N poles and S poles are alternately magnetized on the outer circumferential surface of the mass part 730 throughout the entire circumference, and the turning state of the mass part 730 is detected by detecting a change in magnetic field in accordance with turning of the mass part 730. In FIGS. 2*a* and 2*b*, a part of the magnetized form on the outer circumferential surface of the mass part 730 is schematically illustrated with "N" and "S" indicated therein.

The case body 800 includes a first case member 810, and a second case member 820 disposed in a manner of facing the first case member 810 in the lateral direction, and each of the first case member 810 and the second case member 820 is formed to have substantially a flat plate shape extending vertically using a synthetic resin, a steel plate, or the like.

Bent parts 812 bent toward the second case member 820 are formed at the upper end of the first case member 810 at two places on the front and rear sides. In addition, bent parts 822 bent toward the first case member 810 are formed at two places on the front and rear sides at positions corresponding to the bent parts 812 of the first case member 810 in the second case member 820. The bent parts 812 and 822 are joined to each other using bolts (not illustrated). Thus, the first case member 810 and the second case member 820 are integrated in a form of facing each other with a space therebetween, and the transmission member 600 and the flywheel 700 are sandwiched inside the space.

The first case member 810 includes a pair of pivotal support parts 811 installed at a predetermined interval on the front and rear sides, and the second case member 820 includes a pair of pivotal support parts 821 respectively facing the pair of pivotal support parts 811 in the lateral direction. Accordingly, in a state in which the turning shaft 610 of the transmission member 600 and the rotary shaft 710 of the flywheel 700 are pivotally supported by the pivotal support parts 811 and the pivotal support parts 821 respectively, the first case member 810 and the second case member 820 can be joined to (integrated with) each other.

Thus, the transmission member 600 and the flywheel 700 can be easily installed in the chassis 100 by unitizing the mass body unit 500 in advance. As a result, the ease of assembling of the keyboard device 1000 can be improved. In addition, when damage is caused in the transmission member 600 or the flywheel 700, repair can be easily performed by replacing the mass body unit 500 in which the transmission member 600 and the flywheel 700 are unitized.

The first case member 810 includes a fastening part 813 installed at a lower end thereof on the front side, and a coil spring 814 of which one end is connected to the first case member 810. The fastening part 813 is a part for fixing the mass body unit 500 (the first case member 810 and the second case member 820) to the base 131 of the chassis 100 (refer to FIG. 1*b*), and the coil spring 814 is a member for biasing the transmission member 600.

The second case member 820 includes an insertion part 823 protruding downward from the lower surface thereof on the rear side and bent to the rear side, a contact part 824 for applying frictional resistance to the mass part 730 of the flywheel 700, and a sensor 825 for detecting the turning state of the flywheel 700.

The contact part 824 is formed using felt, a urethane foam, or the like. In a state in which the flywheel 700 is sandwiched between the first case member 810 and the second case member 820, the contact part 824 is installed in contact with the side surface of the mass part 730. That is, frictional resistance is applied to the mass part 730 at all times by the contact part 824. The sensor 825 is a device detecting a change in magnetic field as a voltage change using a Hall element, an MR element, or the like.

Figure 3A:
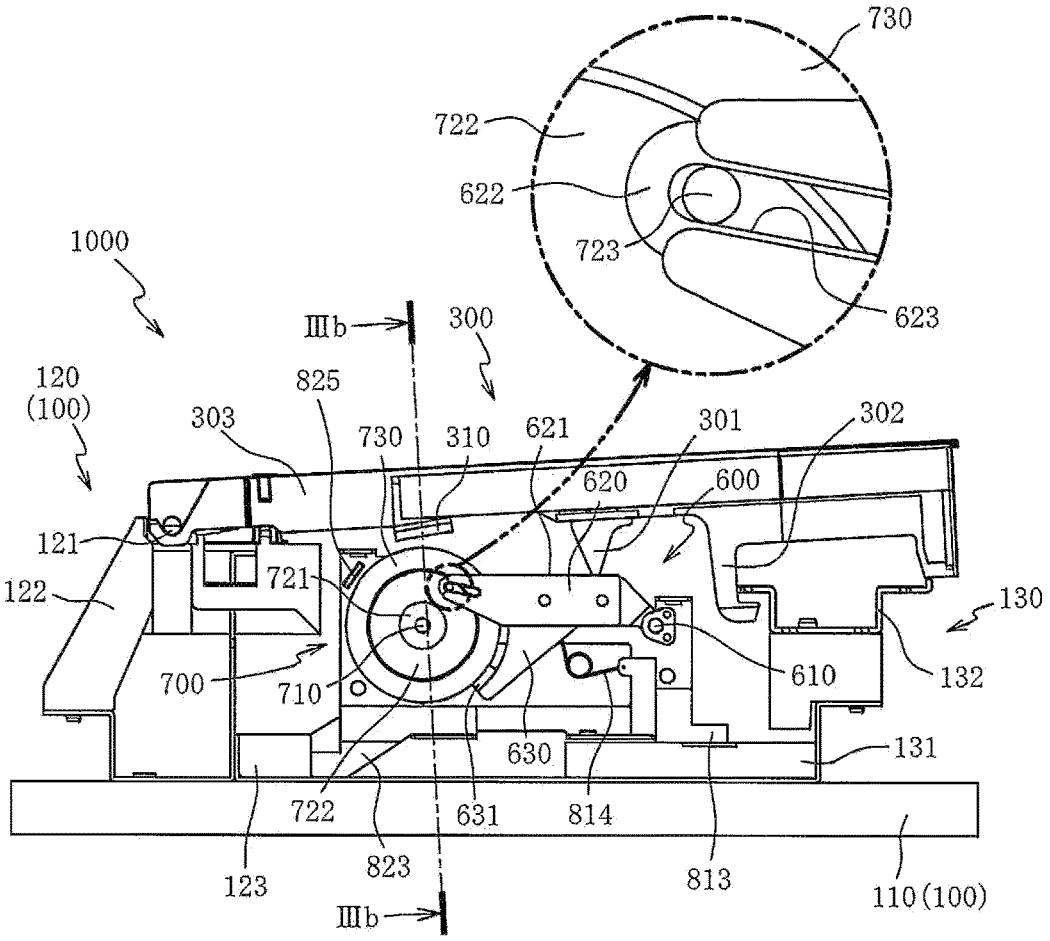
FIG. 3*a* is a side view of the keyboard device.
Figure 3B:
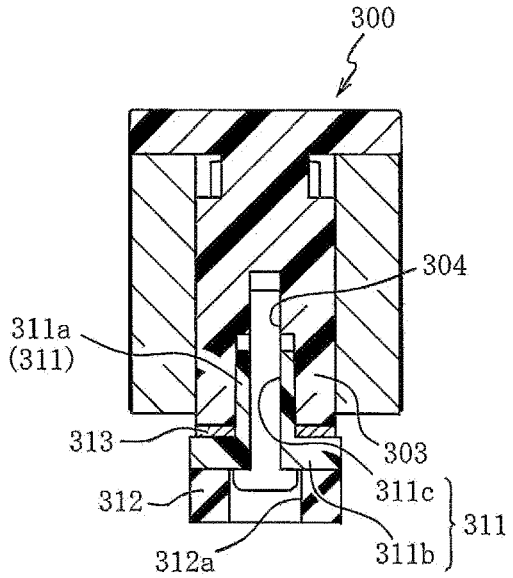
FIG. 3*b* is a cross-sectional view of a white key along line IIIb-IIIb in FIG. 3*a*.

Next, with reference to FIGS. 3*a* and 3*b*, an assembling state of the mass body unit 500 will be described. FIG. 3*a* is a side view of the keyboard device 1000, and FIG. 3*b* is a cross-sectional view of the white key 300 along line IIIb-IIIb in FIG. 3*a*. In order to facilitate understanding, illustration of a part of the keyboard device 1000 is omitted in FIG. 3*a*, and FIG. 3*b* illustrates only the white key 300.

In addition, the assembling state of the mass body unit 500 with respect to the white keys 300 and the black keys 400 and a mechanism in which the flywheel 700 of the mass body unit 500 turns or is braked in a manner of being interlocked with key touching or key release of the white keys 300 and the black keys 400 are substantially the same as each other between the white keys 300 and the black keys 400. Thus, hereinafter, only the structure of the white key 300 will be described, and description of the structure of the black key 400 will be omitted.

As shown in FIG. 3*a*, the insertion part 823 of the second case member 820 is inserted into the holding member 123. The fastening part 813 of the first case member 810 is fastened and fixed to the base 131 in the insertion state thereof, and thus the case body 800 (the mass body unit 500) is fixed to the chassis 100.

In this assembled state (a state before key touching), the turning shaft 610 of the transmission member 600 and the rotary shaft 710 of the flywheel 700 are installed parallel to the shaft part 121. Therefore, the intervals between adjacent keys 200 can be reduced.

In addition, in the assembled state, the projection part 301 of the white key 300 abuts the abutting surface 621 of the transmission member 600, and the white key 300 is biased upward due to a biasing force of the coil spring 814 via the transmission member 600.

That is, in the coil spring 814 of which one end is connected to the first case member 810 (refer to FIG. 2*a*), the other end thereof is connected to the lower surface of the stopper part 630 of the transmission member 600 (refer to FIG. 3*a*). Thus, turning of the transmission member 600 to one side around the turning shaft 610, that is, a downward turning operation of the white key 300, is limited by the coil spring 814. An initial position of the white key 300 in this state before key touching is defined as "a key touching initial position".

An upward turning operation of the white key 300 (the black key 400) from the key touching initial position is restricted by a restriction part 302 of the white key 300 (the black key 400). The restriction part 302 protrudes downward from the lower surface of the white key 300, and the lower end is formed to be bent forward. The bent portion abuts the lower surface of the guide part 132, and thus turning of the white key 300 in a key release direction is restricted to a predetermined amount.

In addition, a downward turning operation of the white key 300 (the black key 400) from the key touching initial position is restricted by a stopper part 310 of the white key 300 (the black key 400). The stopper part 310 is disposed at the key touching initial position in a manner of facing the mass part 730 of the flywheel 700 at a predetermined interval in the upward-downward direction. When the white key 300 is turned downward by a predetermined amount, the stopper part 310 abuts the mass part 730, and thus turning of the white key 300 is restricted (which will be described below in detail).

As shown in FIG. 3*b*, the stopper part 310 includes a plate 311 fixed between a pair of left and right side walls 303 of the white key 300 facing each other, and a cushion 312 bonded to the lower surface of the plate 311 using a bonding agent.

The plate 311 includes an insertion part 311*a* inserted between a pair of side walls 303 facing each other, a sticking part 311*b* sticking out in a flange shape from the lower end of the insertion part 311*a*, and an insertion hole 311*c* vertically penetrating the insertion part 311*a* and the sticking part 311*b*, and is formed to have a T-shape in a cross section using a synthetic resin, a steel plate, or the like.

The cushion 312 includes a vertically penetrating insertion hole 312*a* with opening dimensions larger than those of the insertion hole 311*c* of the plate 311. In the present embodiment, the cushion 312 is formed using a rubber material but may be formed using felt or the like.

A vertically extending female screw hole 304 is formed between the pair of side walls 303 facing each other, and the plate 311 and the cushion 312 are fixed to the white key 300 by fastening bolts inserted through the insertion holes 311*c* and 312*a* into the female screw hole 304.

In addition, the stopper part 310 includes a spacer 313 installed between the lower surfaces of the pair of side walls 303 and the sticking part 311*b*, and the spacer 313 is formed using a synthetic resin, a steel plate, or the like having a thickness of a predetermined amount.

An installation height of the stopper part 310 (the cushion 312) can be changed by changing the thickness of the spacer 313 or detaching the spacer 313. Accordingly, the interval between the stopper part 310 at the key touching initial position and the mass part 730 of the flywheel 700 facing each other can be adjusted. Therefore, the stroke amount of the white key 300 from the key touching initial position can be adjusted.

Figure 4A:
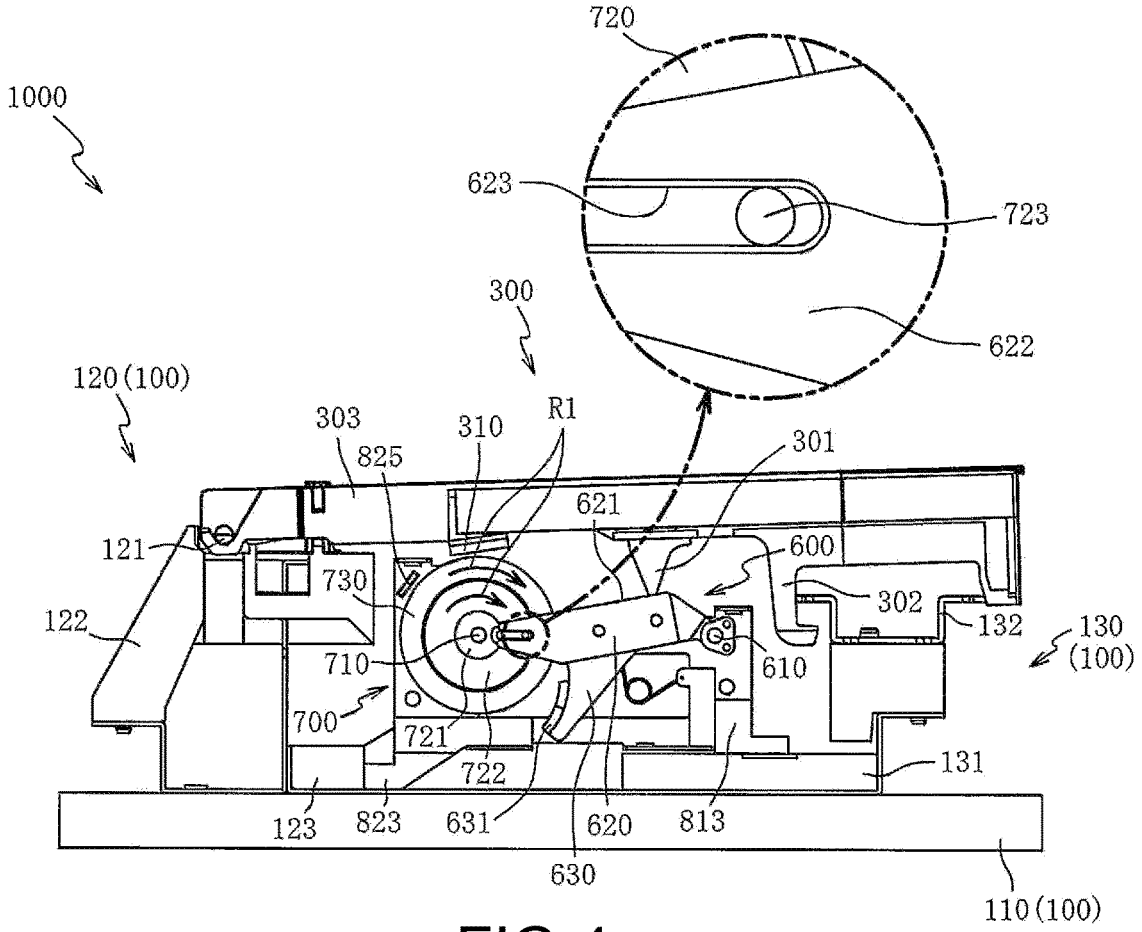
FIG. 4*a* is a side view of the keyboard device showing a state in which the white key is touched from the state in FIG. 3*a*.
Figure 4B:
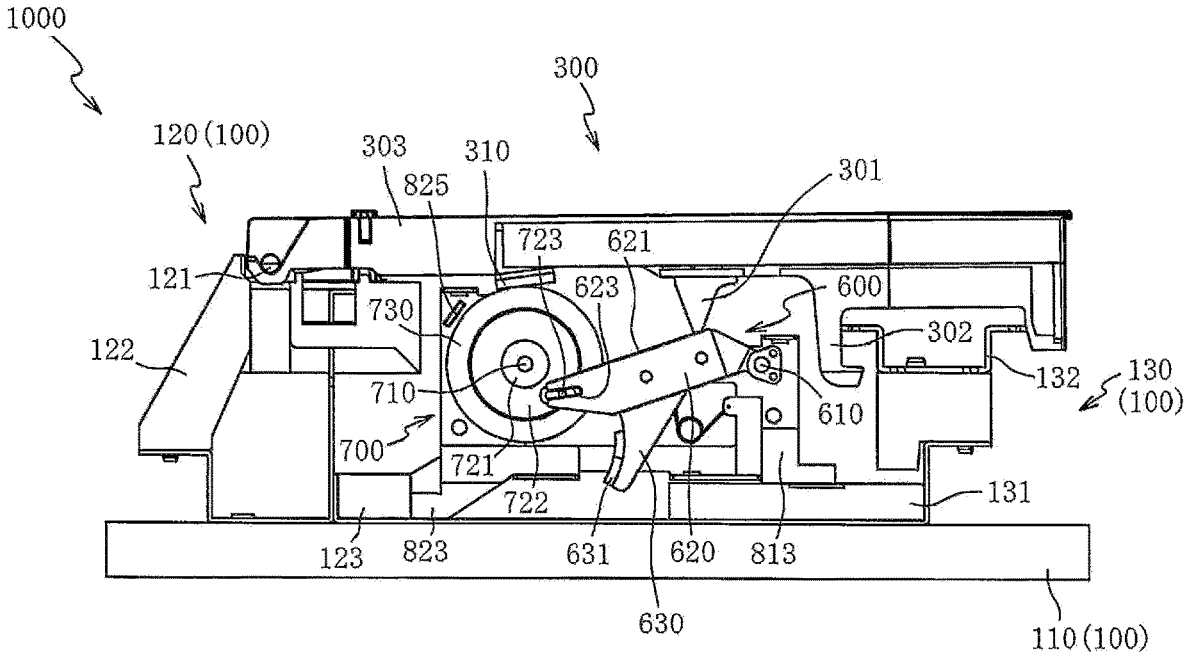
FIG. 4*b* is a side view of the keyboard device showing a state in which the white key is touched to a key touching terminal position from the state in FIG. 4*a*.

Next, with reference to FIGS. 4*a*, 4*b* and 5*a*, 5*b*, operation of the mass body unit 500 when the white key 300 is subjected to key touching or key release will be described. FIG. 4*a* is a side view of the keyboard device 1000 showing a state in which the white key 300 is touched from the state in FIG. 3*a*, and FIG. 4*b* is a side view of the keyboard device 1000 showing a state in which the white key 300 is touched to a key touching terminal position from the state in FIG. 4*a*). FIG. 4*a* illustrates a state in which the white key 300 is positioned between the key touching initial position and the key touching terminal position.

As shown in FIG. 4*a*, when the white key 300 is touched from the key touching initial position shown in FIG. 3*a*, the white key 300 is turned downward with the shaft part 121 of the chassis 100 as a turning center. Due to turning of this white key 300, the projection part 301 of the white key 300 pressurizes the abutting surface 621 of the transmission member 600 downward and slides, and the transmission member 600 is turned downward with the turning shaft 610 as the turning center.

At this time, the protrusion part 723 of the flywheel 700 is engaged with the groove part 623. Therefore, the protrusion part 723 slides along the groove part 623 in accordance with turning of the transmission member 600, and the outer wheel 722 turns in one direction (arrow R1 direction) with the rotary shaft 710 as the turning center (a transmitting step).

The flywheel 700 is configured to serve as a one-way clutch transmitting a torque in one direction (arrow R1 side) between the inner wheel 721 and the outer wheel 722. Therefore, the inner wheel 721 and the mass part 730 are driven after turning of the outer wheel 722 in one direction. That is, when the white key 300 is touched, the outer wheel 722, the inner wheel 721, and the mass part 730 are turned integrally. Therefore, a key touching feeling can be applied due to the inertial moment of the outer wheel 722, the inner wheel 721, and the mass part 730 (a key touching feeling applying step).

In this case, due to the configuration in which a driving force from the white key 300 is transmitted to the outer wheel 722, it is difficult to obtain the inertial moment with only the weight of the inner wheel 721. In contrast, in the present embodiment, the mass part 730 is connected (fixed) to the inner wheel 721 via the rotary shaft 710. Therefore, the inner wheel 721 and the mass part 730 can be turned integrally. Thus, the inertial moment can be obtained due to the weight of the mass part 730. Therefore, even with a configuration in which a driving force from the white key 300 is transmitted to the outer wheel 722, a sufficient key touching feeling can be applied.

In addition, as shown in the enlarged portion of FIG. 4*a*, in the middle of key touching of the white key 300, a gap is formed between the front end (a terminal on the right side in FIG. 4*a*) of the groove part 623 and the protrusion part 723. Thus, abutment (collision) between the terminal of the groove part 623 and the protrusion part 723 can be avoided. Therefore, generation of noise caused by the abutment (collision) can be curbed.

N poles and S poles are alternately magnetized on the outer circumferential surface of the mass part 730 (refer to FIGS. 2*a* and 2*b*), and the sensor 825 is installed in a manner of facing the outer circumferential surface. Thus, a change (a change in rotation speed of the mass part 730) in magnetic field in accordance with turning of the mass part 730 is detected by the sensor 825. Therefore, key touching information of the white key 300 can be detected by the sensor 825, and a musical sound signal based on the detection result thereof can be output to the outside (a detecting step). In addition, the detection accuracy of key touching information of the white key 300 can be easily enhanced by having dense installation pitches of the N poles and the S poles on the outer circumferential surface of the mass part 730 in the circumferential direction.

Here, if the purpose is simply to transmit a driving force from the white key 300 to the outer wheel 722, for example, a configuration corresponding to the groove part 623 or the protrusion part 723 may be formed in the projection part 301 of the white key 300 or the outer wheel 722. However, in such a configuration, the turning amount of the outer wheel 722 depends on only the stroke amount of the white key 300. Therefore, there is concern that it will become difficult to apply a sufficient key touching feeling.

In contrast, in the present embodiment, a driving force in response to turning of the white key 300 is transmitted to the outer wheel 722 via the transmission member 600. Therefore, a sufficient key touching feeling can be applied. That is, when the turning shaft 610 of the transmission member 600 is adopted as a fulcrum, the distance from an engagement position (an action point) between the groove part 623 and the protrusion part 723 to the fulcrum is set to be longer than the distance from an abutting position (a force point) between the projection part 301 and the abutting surface 621 to the fulcrum.

Accordingly, the turning amount of the outer wheel 722 can become larger than the stroke amount of the white key 300. Moreover, a driving force required to turn the outer wheel 722 can be increased. Thus, a sufficient key touching feeling can be applied when the white key 300 is touched from the key touching initial position.

In this manner, in order to apply a sufficient key touching feeling, the distance from the fulcrum to the action point may be set to be longer than the distance from the fulcrum to the force point. Thus, for example, as in a third embodiment (refer to FIG. 6*b*) which will be described below, even when an abutting position (a force point) between the projection part 301 and an abutting surface 3621 is positioned on a side in front of the turning shaft 610 (the fulcrum) and an engagement position (an action point) between a groove part 3623 and the protrusion part 723 is positioned on a side behind the turning shaft 610, a sufficient key touching feeling can be applied with a configuration in which the distance from the fulcrum to the action point is set to be longer than the distance from the fulcrum to the force point.

However, in such a configuration, the force point or the action point is positioned on both the front side and the rear side with the turning shaft 610 interposed therebetween. Therefore, in order to apply a sufficient key touching feeling, a transmission member 3600 has to be formed to be relatively longer in the forward-rearward direction.

In contrast, in the present embodiment, the abutting position between the projection part 301 and the abutting surface 621 is positioned on a side behind the turning shaft 610, and the groove part 623 and the protrusion part 723 are engaged with each other on a side behind the abutting position. Accordingly, the overall length of the transmission member 600 can be shortened, and a sufficient key touching feeling can be applied at the time of key touching of the white key 300.

In addition, at the key touching initial position, the engagement position between the protrusion part 723 and the groove part 623 is positioned between the rotary shaft 710 and the turning shaft 610 (above the rotary shaft 710 and the turning shaft 610). Therefore, when the inner wheel 721 turns in one direction, the protrusion part 723 slides along the groove part 623 in a manner of approaching the turning shaft 610.

Accordingly, the distance from the engagement position (the action point) between the protrusion part 723 and the groove part 623 to the turning shaft 610 (the fulcrum) becomes longer at the key touching initial position than in the middle of key touching. Thus, a driving force required to turn the outer wheel 722 from the key touching initial position can be increased. Therefore, a sufficient key touching feeling can be applied in an initial stage of turning of the white key 300.

As shown in FIG. 4*b*, when the white key 300 is touched by a predetermined amount, the stopper part 310 abuts the mass part 730 so that turning of the white key 300 is restricted and the outer wheel 722 stops. In addition, turning of the mass part 730 is braked by the frictional resistance of the stopper part 310, and the mass part 730 stops. The position of the white key 300 in a state in which this stopper part 310 abuts the mass part 730 is defined as "the key touching terminal position".

In this key touching terminal position, a gap is formed between the terminal (the end part on the left side in FIG. 4*b*) of the groove part 623 and the protrusion part 723. Thus, abutment (collision) between the terminal of the groove part 623 and the protrusion part 723 can be avoided. Therefore, generation of noise caused by the abutment (collision) can be curbed.

Here, as described above, in the present embodiment, the stroke amount of the white key 300 can be adjusted by changing the installation height of the stopper part 310. In this case, as in the related art (for example, Japanese Patent Laid-Open No. 2014-066929), in the case of a configuration in which key touching information is detected by a sensor that is pressurized by a key, if the stroke amount of the key is changed, there is concern that the sensor may not be pressurized by the key or a force of pressurizing the sensor may become excessively large. Thus, in the configuration in the related art, when the stroke amount of the key is changed, the installation position of the sensor also has to be changed in accordance therewith.

In contrast, in the present embodiment, key touching information of the white key 300 can be detected by the sensor 825 detecting the turning state of the mass part 730. Therefore, when the stroke amount of the white key 300 is changed, there is no need to adjust the installation position of the sensor 825.

Figure 5A:
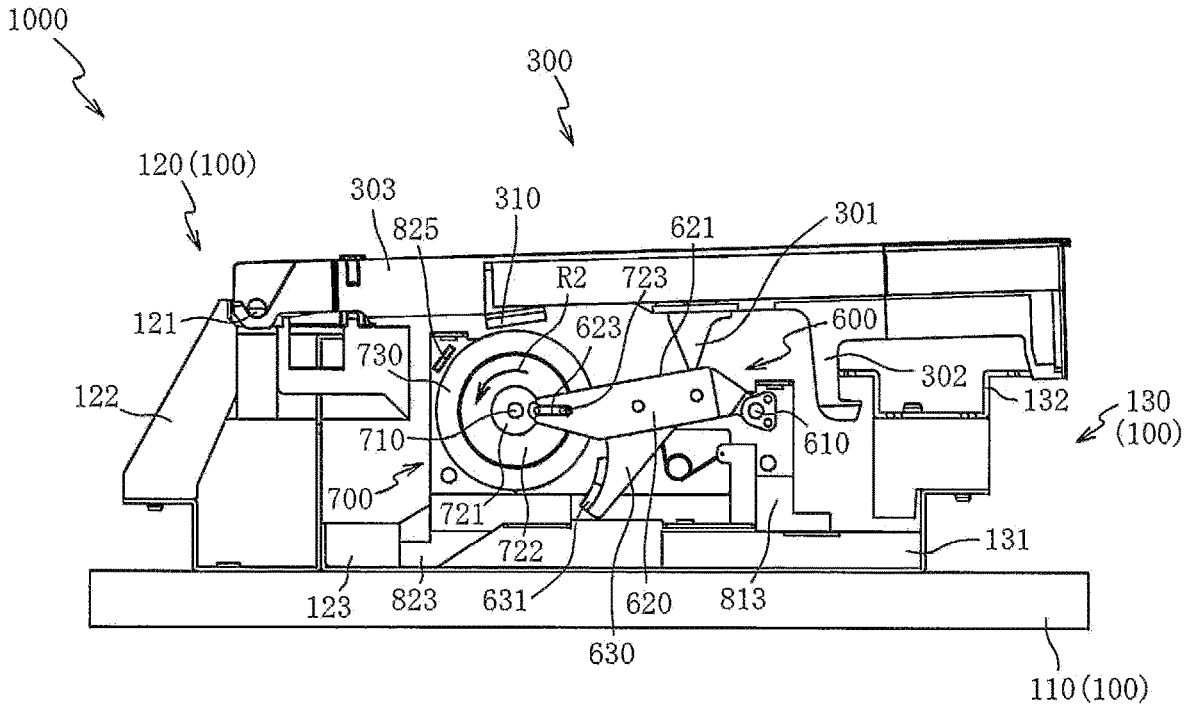
FIG. 5*a* is a side view of the keyboard device showing a state in which the white key is released from the state in FIG. 4*b*.
Figure 5B:
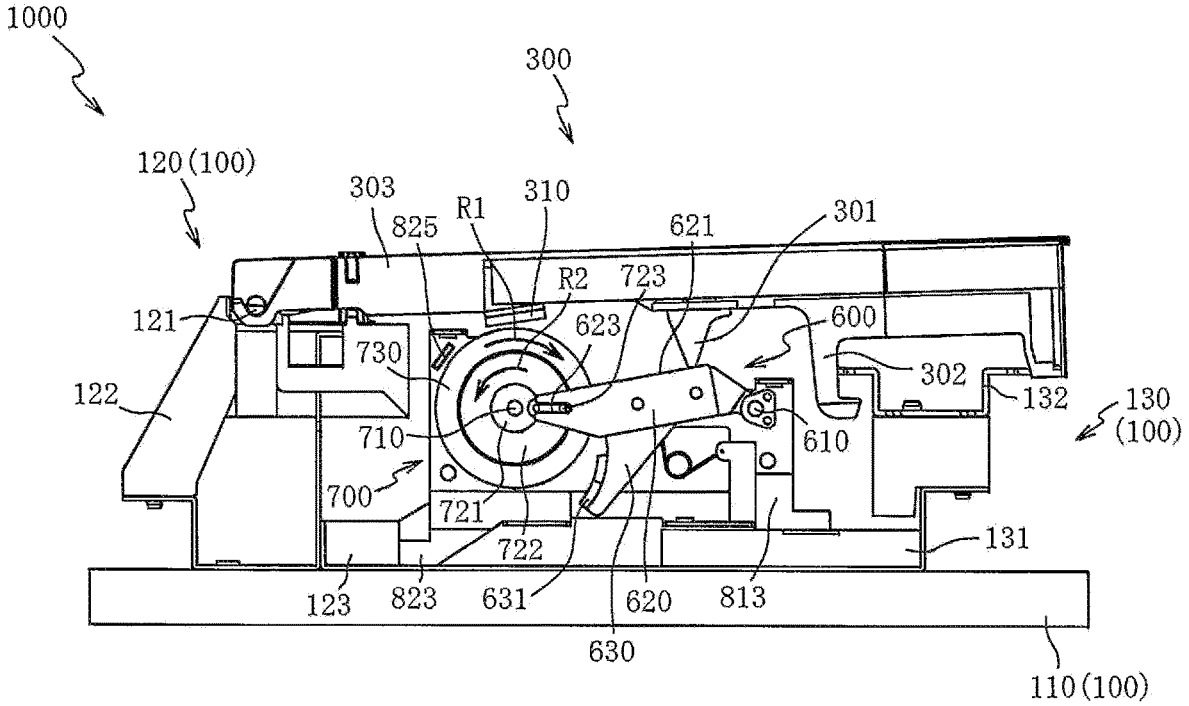
FIG. 5*b* is a side view of the keyboard device showing a state in which the white key is released before being touched to the key touching terminal position.

Next, with reference to FIGS. 5*a* and 5*b*, a case in which the white key 300 is released will be described. FIG. 5*a* is a side view of the keyboard device 1000 showing a state in which the white key 300 is released from the state in FIG. 4*b*, and FIG. 5*b* is a side view of the keyboard device 1000 showing a state in which the white key 300 is released before being touched to the key touching terminal position. FIG. 5*a* illustrates a state in which the white key 300 is positioned between the key touching initial position and the key touching terminal position.

As shown in FIG. 5*a*, when the white key 300 is subjected to key release from the key touching terminal position (a state in FIG. 4*b*), the white key 300 and the transmission member 600 are turned due to a biasing force of the coil spring 814 in a direction in which they return to the key touching initial position with the shaft part 121 or the turning shaft 610 as the turning center.

In accordance with turning of the white key 300 or the transmission member 600, the outer wheel 722 turns in the other direction (arrow R2 direction) opposite to that at the time of key touching. In this case, the flywheel 700 is configured to serve as a one-way clutch transmitting a torque in one direction between the inner wheel 721 and the outer wheel 722. Therefore, the inner wheel 721 is not driven after turning of the outer wheel 722 in the other direction, and no torque is transmitted to the mass part 730. That is, only the outer wheel 722 can be turned in the other direction. Therefore, the white key 300 can return to the key touching initial position without being influenced by the inertial moment of the mass part 730 (the key touching feeling applying step). Thus, the time for the white key 300 to return to the key touching initial position can be shortened. Therefore, the ease of continuous keying of the white keys 300 can be improved.

In addition, at the time of key touching or at the time of key release of the white key 300, the engagement state between the groove part 623 of the transmission member 600 and the protrusion part 723 of the flywheel 700 is maintained at all times. Accordingly, when the white key 300 returns to the key touching initial position, collision of the transmission member 600 with the flywheel 700 and generation of noise can be curbed. Thus, improvement in ease of continuous keying of the white keys 300 and curbing of generation of noise can be balanced.

In addition, at the key touching initial position (refer to FIG. 3*a*), a gap is formed between the terminal (the end part on the left side in FIG. 3*a*) of the groove part 623 of the transmission member 600 and the protrusion part 723 of the flywheel 700. Accordingly, abutment (collision) between the terminal of the groove part 623 and the protrusion part 723 can be avoided when the white key 300 returns to the key touching initial position. Therefore, generation of noise caused by the abutment (collision) can be curbed.

When the white key 300 returns to the key touching initial position, the cushioning member 631 of the stopper part 630 abuts the mass part 730, and thus turning of the mass part 730 is braked. Accordingly, when the white key 300 is touched again after it has returned to the key touching initial position, the outer wheel 722, the inner wheel 721, and the mass part 730 can be turned integrally. Therefore, a key touching feeling can be reliably applied.

In this manner, at the time of key touching or at the time of key release of the white key 300, the projection part 301 of the white key 300 abuts the abutting surface 621 of the transmission member 600, but the projection part 301 and the abutting surface 621 are not engaged with each other. Thus, a structure can be simplified compared to a case in which the white key 300 and the transmission member 600 are engaged and interlocked with each other.

In addition, the white key 300 and the transmission member 600 can return to the key touching initial position at the same time due to the coil spring 814. Therefore, separation of the white key 300 from the transmission member 600 can be curbed at the time of this returning. Thus, even when the white key 300 and the transmission member 600 are not engaged with each other, abutment of the transmission member 600 with respect to the white key 300 which has returned to the key touching initial position or abutment of the white key 300 with respect to the transmission member 600 when the white key 300 is touched again (particularly, at the time of continuous keying) can be controlled. As a result, generation of noise can be curbed.

On the other hand, as shown in FIG. 5*b*, when the white key 300 is subjected to key release without being touched to the key touching terminal position, that is, when the stopper part 310 of the white key 300 is subjected to key release before abutting the mass part 730, the outer wheel 722 turns in the other direction (arrow R2 direction), but the inner wheel 721 and the mass part 730 tend to continuously turn in one direction (arrow R1 direction).

In a state in which the mass part 730 turns, the inertial moment of the mass part 730 is reduced. Therefore, when the white key 300 is touched again from that state (before the white key 300 returns to the key touching initial position), a key touching feeling is reduced. In contrast, in the present embodiment, the contact part 824 (refer to FIG. 2*a*) abuts the side surface of the mass part 730 at all times. Therefore, continuous turning of the mass part 730 in one direction can be curbed. Thus, even when the white key 300 is subjected to continuous keying, a key touching feeling can be applied due to the inertial moment of the mass part 730.

In this manner, according to the keyboard device 1000 of the present embodiment, the outer wheel 722, the inner wheel 721 (the clutch part 720), and the mass part 730 are turned integrally at the time of key touching of the white key 300. Therefore, a sufficient key touching feeling can be applied utilizing the weight of the entire flywheel 700. On the other hand, at the time of key release of the white key 300, the ease of continuous keying can be improved by reducing a weight of the appearance of the flywheel 700 to the extent that as the inner wheel 721 or the mass part 730 is not turned.

Figure 6B:
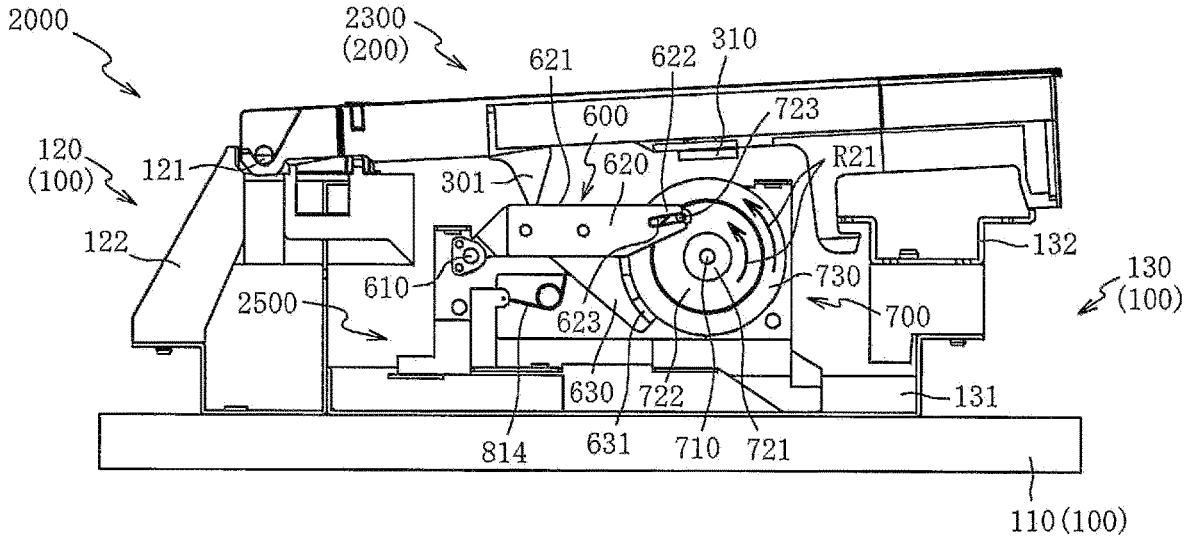
FIG. 6*b* is a side view of a keyboard device according to a third embodiment.
Figure 6A:
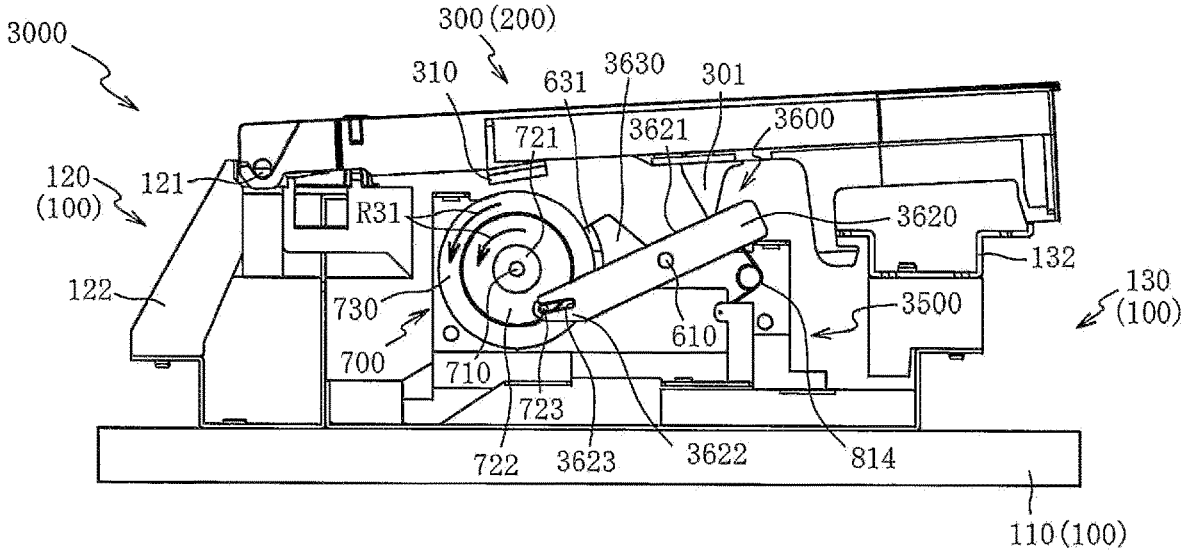
FIG. 6*a* is a side view of a keyboard device according to a second embodiment.

Next, with reference to FIG. 6*a*, a second embodiment will be described. In the first embodiment, a case in which the flywheel 700 is installed on the rear side of the transmission member 600 has been described. However, in the second embodiment, the flywheel 700 is installed on the front side of the transmission member 600. The same reference signs are applied to the same portions as the first embodiment described above, and description thereof will be omitted. FIG. 6*a* is a side view of a keyboard device 2000 according to the second embodiment.

As shown in FIG. 6*a*, a mass body unit 2500 of the keyboard device 2000 is disposed in a posture in which the turning shaft 610 of the transmission member 600 is positioned on the rear end side (the left side in FIG. 6*a*) of white keys 2300 and the rotary shaft 710 of the flywheel 700 is positioned on a side in front (the right side in FIG. 6*a*) of the turning shaft 610. That is, the mass body unit 2500 has substantially the same configuration as the mass body unit 500 of the first embodiment except that the installation direction is reversed in the forward-rearward direction.

The projection part 301 of the white key 2300 is disposed at a position where it can abut the abutting surface 621 of the transmission member 600, and the stopper part 310 is disposed at a position where it can abut the mass part 730 of the flywheel 700.

Accordingly, when the white key 2300 is touched, the transmission member 600 turns around the turning shaft 610, and a driving force in response to key touching of the white key 2300 is transmitted to the flywheel 700. The flywheel 700 is configured to serve as a one-way clutch transmitting a torque in one direction (arrow R21 side) between the inner wheel 721 and the outer wheel 722. Therefore, a sufficient key touching feeling can be applied by integrally turning the outer wheel 722, the inner wheel 721, and the mass part 730 at the time of key touching of the white key 2300. On the other hand, at the time of key release of the white key 2300, the ease of continuous keying can be improved by reducing the weight of the appearance of the flywheel 700 to the extent that as the inner wheel 721 and the mass part 730 are not turned.

In addition, the flywheel 700 is installed on the front side of the transmission member 600. Therefore, compared to the first embodiment, the flywheel 700 can be disposed at a position away from the shaft part 121 where the white key 2300 is pivotably supported. Accordingly, a stroke amount until the stopper part 310 of the white key 2300 abuts the mass part 730 of the flywheel 700 can be set to be large. Thus, an adjustment range (an adjustment range of the stroke amount of the white key 2300) of the installation height of the stopper part 310 can be expanded.

Next, with reference to FIG. 6*b*, the third embodiment will be described. In the first embodiment, a case in which the abutting position between the white key 300 and the transmission member 600 is positioned on a side behind the turning shaft 610 of the transmission member 600 has been described. However, in the third embodiment, the abutting position between the white key 300 and the transmission member 3600 is positioned on a side in front of the turning shaft 610 of the transmission member 3600. The same reference signs are applied to the same portions as the first embodiment described above, and description thereof will be omitted. FIG. 6*b* is a side view of a keyboard device 3000 according to the third embodiment.

As shown in FIG. 6*b*, a mass body unit 3500 of the keyboard device 3000 includes the transmission member 3600 for transmitting a driving force in response to key touching of the white key 300 to the flywheel 700. The transmission member 3600 includes the turning shaft 610, a main body part 3620 turning around the turning shaft 610, and a stopper part 3630 protruding upward from the upper surface of the main body part 3620.

The main body part 3620 extends from the turning shaft 610 toward both the front and rear sides, and the upper surface of the main body part 3620 is a flat surface extending forward and rearward. The flat surface is configured to serve as the abutting surface 3621 that the projection parts 301 of the white keys 300 abut. Each of the abutting position between the abutting surface 3621 and the projection parts 301 and the connection position between the lower surface of the main body part 3620 and the coil spring 814 is positioned on a side in front (the right side in FIG. 6*b*) of the turning shaft 610.

In addition, the main body part 3620 includes an engagement part 3622 protruding rearward beyond the abutting surface 3621 (the turning shaft 610), and a groove part 3623 having a groove shape is formed in the rear end part of the engagement part 3622. The groove part 3623 is formed to have a linear shape extending forward and rearward, and the protrusion part 723 is slidably engaged with (inserted through) the groove part 3623.

In the engagement state thereof, the stopper part 3630 is installed in a manner of facing the outer circumferential surface of the flywheel 700 on a side above the rotary shaft 710. The cushioning member 631 is bonded to the protruding distal end side (a part facing the flywheel 700) of the stopper part 3630.

When the white key 300 is touched, the protrusion part 723 slides along the groove part 3623 and the transmission member 3600 turns around the turning shaft 610, and thus a driving force in response to key touching of the white key 300 is transmitted to the flywheel 700.

The flywheel 700 is configured to serve as a one-way clutch transmitting a torque in one direction (arrow R31 side) between the inner wheel 721 and the outer wheel 722. Therefore, a sufficient key touching feeling can be applied by integrally turning the outer wheel 722, the inner wheel 721, and the mass part 730 at the time of key touching of the white key 300. On the other hand, at the time of key release of the white key 300, the ease of continuous keying can be improved by reducing the weight of the appearance of the flywheel 700 to the extent that as the inner wheel 721 and the mass part 730 are not turned.

In addition, the abutting position between the abutting surface 3621 and the projection part 301 is positioned on a side in front of the turning shaft 610, and thus a part of the transmission member 3600 on a side behind the turning shaft 610 turns upward at the time of key touching and turns downward at the time of key release.

In this case, the stopper part 3630 is formed on a side behind the turning shaft 610, and thus the center of gravity of the transmission member 3600 is positioned on a side behind the turning shaft 610. Accordingly, at the time of key release, in addition to a biasing force of the coil spring 814, the white key 300 can return to the key touching initial position by utilizing the dead weight of the transmission member 3600. Thus, the time taken when the white key 300 returns can be shortened. As a result, the ease of continuous keying can be improved.

Figure 7A:
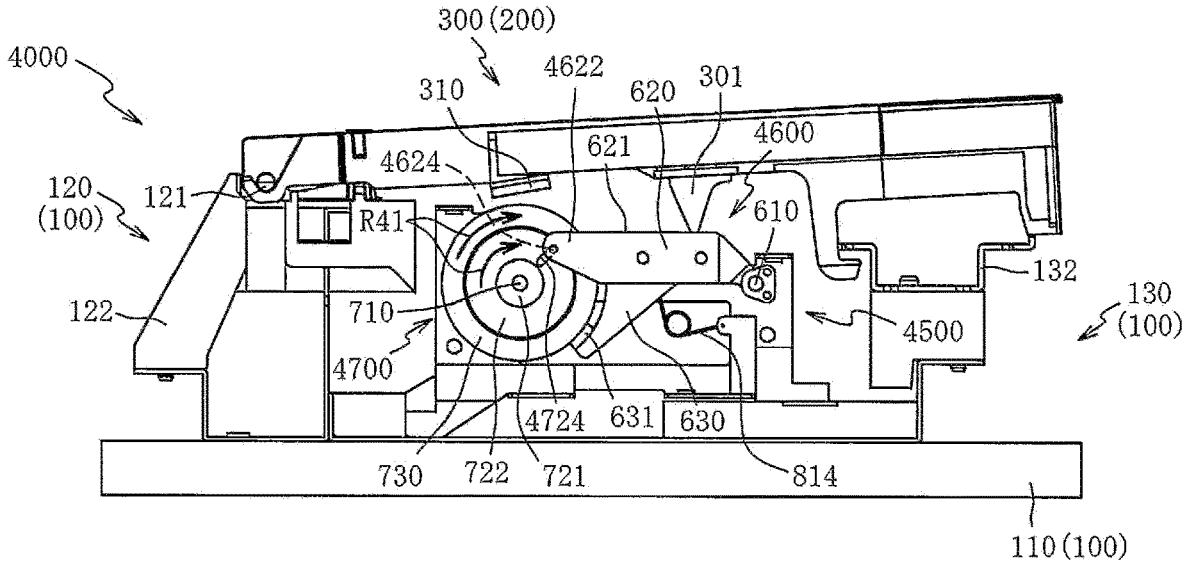
FIG. 7*a* is a side view of a keyboard device according to a fourth embodiment.

Next, with reference to FIG. 7*a*, a fourth embodiment will be described. In the first embodiment, a case in which the groove part 623 is formed in the transmission member 600 and the protrusion part 723 is formed in the outer wheel 722 of the flywheel 700 has been described. However, in the fourth embodiment, a protrusion part 4624 is formed in a transmission member 4600, and a groove part 4724 is formed in the outer wheel 722 of a flywheel 4700. The same reference signs are applied to the same portions as the first embodiment described above, and description thereof will be omitted. FIG. 7*a* is a side view of a keyboard device 4000 according to the fourth embodiment.

As shown in FIG. 7*a*, a mass body unit 4500 of the keyboard device 4000 includes the transmission member 4600 for transmitting a driving force in response to key touching of the white key 300 to the flywheel 700. The main body part 620 of the transmission member 4600 includes an engagement part 4622 protruding rearward beyond the abutting surface 621 (the turning shaft 610), and the protrusion part 4624 is formed on an inner surface (a surface facing the outer wheel 722, that is, a surface on a deeper side of the sheet in FIG. 7*a*) of the engagement part 4622.

The protrusion part 4624 protrudes from the inner surface of the engagement part 4622 toward the side surface of the outer wheel 722. A groove part 4724 having a groove shape radially extending from the outer wheel 722 is formed on the side surface of the outer wheel 722, and the protrusion part 4624 is slidably engaged with (inserted through) this groove part 4724.

When the white key 300 is touched, the protrusion part 4624 slides along the groove part 4724 and the transmission member 4600 turns around the turning shaft 610. Thus, a driving force in response to key touching of the white key 300 is transmitted to the flywheel 4700.

The flywheel 4700 is configured to serve as a one-way clutch transmitting a torque in one direction (arrow R41 side) between the inner wheel 721 and the outer wheel 722, and thus a sufficient key touching feeling can be applied by integrally turning the outer wheel 722, the inner wheel 721, and the mass part 730 at the time of key touching of the white key 300. On the other hand, at the time of key release of the white key 300, the ease of continuous keying can be improved by reducing the weight of the appearance of the flywheel 4700 to the extent that as the inner wheel 721 and the mass part 730 are not turned.

Next, with reference to FIG. 7*b*, a fifth embodiment will be described. In the first embodiment, a case in which the protrusion part 723 is formed in the outer wheel 722 (a driving force from a key is transmitted to the outer wheel 722) has been described. However, in the fifth embodiment, a case in which the protrusion part 723 is formed in the inner wheel 721 (a driving force from a key is transmitted to the inner wheel 721) will be described. The same reference signs are applied to the same portions as the first embodiment described above, and description thereof will be omitted.

Figure 7B:
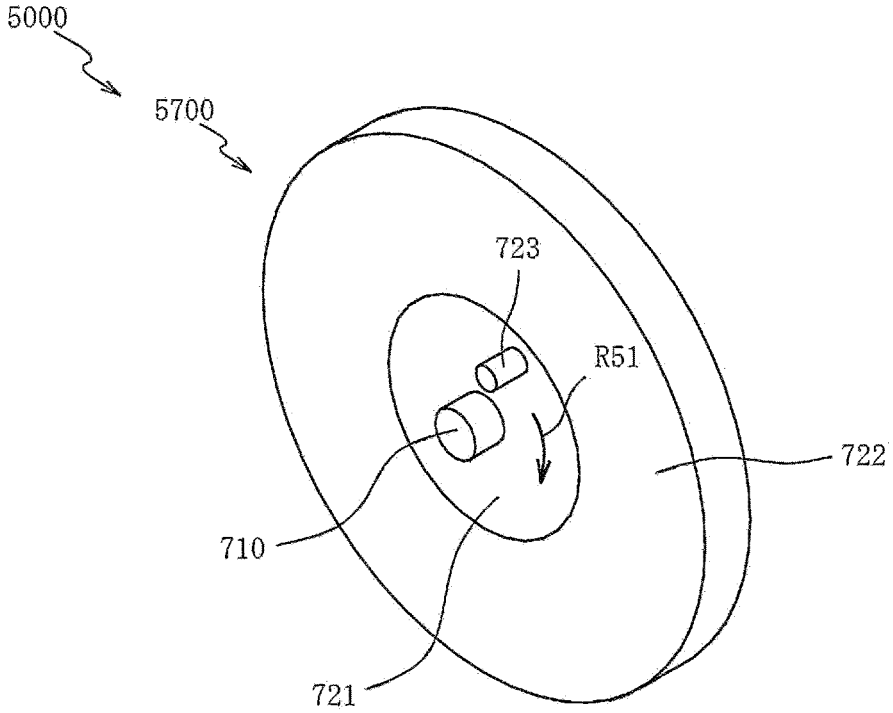
FIG. 7*b* is a perspective view of a keyboard device according to a fifth embodiment.

FIG. 7*b* is a perspective view of a keyboard device 5000 according to the fifth embodiment. In order to simplify the drawing, FIG. 7*b* illustrates only a flywheel 5700.

As shown in FIG. 7*b*, the keyboard device 5000 includes the flywheel 5700 to which a driving force in response to key touching of a key is applied via a transmission member. The flywheel 5700 includes the rotary shaft 710, the inner wheel 721 fixed to the rotary shaft 710, the outer wheel 722 (the mass part) installed on a radially outward side of the inner wheel 721, and a roller and a spring (not illustrated) interposed between the inner wheel 721 and the outer wheel 722 and is configured to serve as a one-way clutch transmitting a torque in only one direction (arrow R51 direction) between the inner wheel 721 and the outer wheel 722.

The protrusion part 723 is formed on the side surface of the inner wheel 721, and the groove part 623 of the transmission member 600 (refer to FIG. 2*a*) is engaged with this protrusion part 723. Thus, when the inner wheel 721 rotates in one direction (arrow R51 direction) due to a driving force transmitted to the inner wheel 721, a torque (a rotation force in the arrow R51 direction) is transmitted to the outer wheel 722 (the mass part). On the other hand, in the configuration, when the inner wheel 721 rotates in the other direction (to the opposite side in the arrow R51 direction), no torque is transmitted to the outer wheel 722 (the mass part).

In this manner, if a driving force from a key is transmitted to the inner wheel 721 in the configuration, the outer wheel 722 in which the inertial moment can be easily obtained compared to the inner wheel 721 can function as a mass part (a part having a predetermined weight for applying a key touching feeling). Thus, the flywheel 5700 can be reduced in size, and a sufficient key touching feeling can be applied at the time of key touching of a key.

Next, with reference to FIGS. 8*a*-8*c*, a sixth embodiment will be described. In the first embodiment, a case in which the groove part 623 of the transmission member 600 is formed to have a linear shape has been described. However, in the sixth embodiment, a groove part 6623 of a transmission member 6600 is formed in a manner of being bent. The same reference signs are applied to the same portions as the first embodiment described above, and description thereof will be omitted.

Figure 8A:
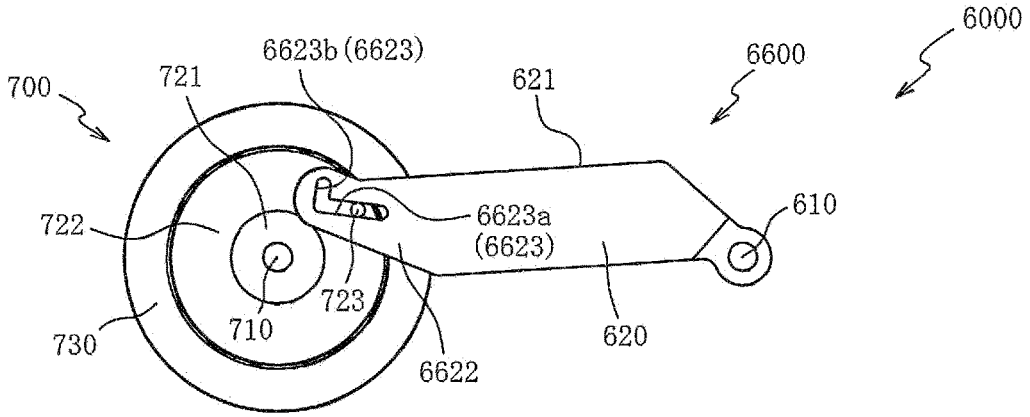
FIG. 8*a* is a side view of a keyboard device according to a sixth embodiment.
Figure 8B:
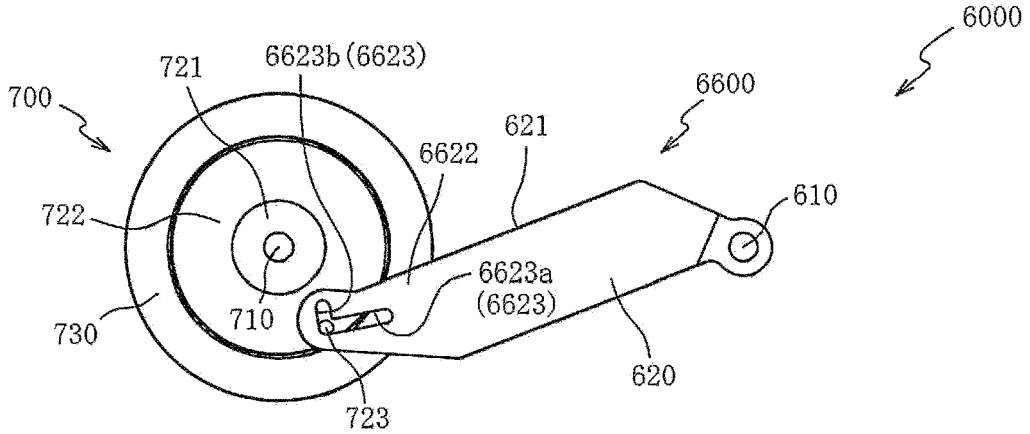
FIG. 8*b* is a side view of a keyboard device showing a state in which a key is touched from the state in FIG. 8*a*.
Figure 8C:
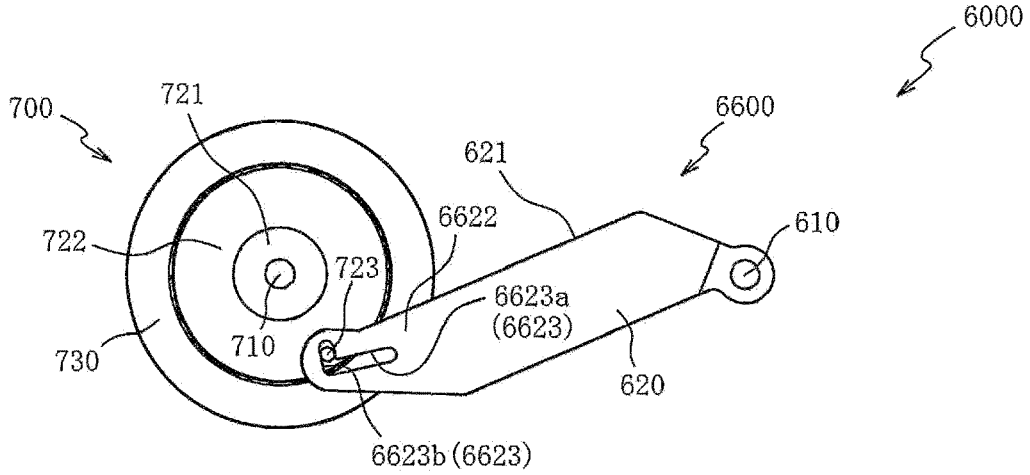
FIG. 8*c* is a side view of the keyboard device showing a state in which the key is touched to the key touching terminal position from the state in FIG. 8*b*.

FIG. 8*a* is a side view of a keyboard device 6000 according to the sixth embodiment, FIG. 8*b* is a side view of the keyboard device 6000 showing a state in which a key is touched from the state in FIG. 8*a*, and FIG. 8*c* is a side view of the keyboard device 6000 showing a state in which a key is touched to the key touching terminal position from the state in FIG. 8*b*. In order to simplify the drawing, FIGS. 8*a*-8*c* illustrate only the transmission member 6600 and the flywheel 700. In addition, FIG. 8*a* illustrates a state at the key touching initial position.

As shown in FIG. 8*a*, the keyboard device 6000 includes the transmission member 6600 for transmitting a driving force in response to key touching of a key to the flywheel 700. The main body part 620 of the transmission member 6600 includes an engagement part 6622 protruding rearward beyond the abutting surface 621 (the turning shaft 610), and the groove part 6623 is formed at the rear end part of the engagement part 6622.

The groove part 6623 includes a first groove part 6623*a* linearly extending in a straight axial direction of the turning shaft 610, and a second groove part 6623*b* extending upward (having an arc shape along a part around the shaft of the turning shaft 610) from the rear end (the end part on the left side in FIGS. 6*a* and 6*b*) of the first groove part 6623*a* and is configured to serve as a groove having substantially an L-shape in a side view.

The protrusion part 723 is slidably engaged with (inserted through) the groove part 6623, and the protrusion part 723 is engaged with the first groove part 6623*a* at the key touching initial position. In addition, the engagement position between the first groove part 6623*a* and the protrusion part 723 at the key touching initial position is positioned between the turning shaft 610 and the rotary shaft 710 (above the turning shaft 610 and the rotary shaft 710).

As shown in FIG. 8*b*, when a key is touched, until the protrusion part 723 reaches the terminal (the end part on the left side in FIG. 8*b*) of the first groove part 6623*a*, similar to the case of the first embodiment, a driving force in response to key touching of a key is transmitted to the flywheel 700 via the transmission member 6600.

On the other hand, as shown in FIG. 8*c*, when the protrusion part 723 is further touched after it has reached the terminal position of the first groove part 6623*a*, the protrusion part 723 slides inside the groove of the second groove part 6623*b*. Therefore, transmission of a driving force in response to key touching of a key to the flywheel 700 can be curbed. In other words, transmission of the inertial moment of the flywheel 700 to a key via the transmission member 6600 can be curbed.

Accordingly, a feeling of touching a key at a position close to the key touching terminal position can be made light. Therefore, a let-off feeling of an acoustic piano can be applied. In this manner, various key touching feelings can be applied by forming a region in which a driving force in response to key touching of a key is transmitted to the flywheel 700 and a non-transmission region in the groove part.

Next, with reference to FIGS. 9*a* and 9*b*, a seventh embodiment and an eighth embodiment will be described. In the first embodiment, a case in which a driving force is transmitted to the flywheel 700 due to engagement between the groove part 623 of the transmission member 600 and the protrusion part 723 of the flywheel 700 has been described. However, in the seventh and eighth embodiments, a driving force is transmitted to flywheels 7700 and 8700 by a gear or due to a frictional force. The same reference signs are applied to the same portions as the first embodiment described above, and description thereof will be omitted.

Figure 9A:
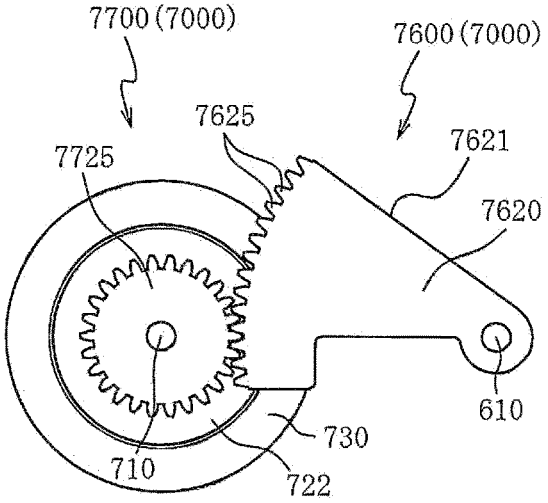
FIG. 9*a* is a side view of a keyboard device according to a seventh embodiment.
Figure 9B:
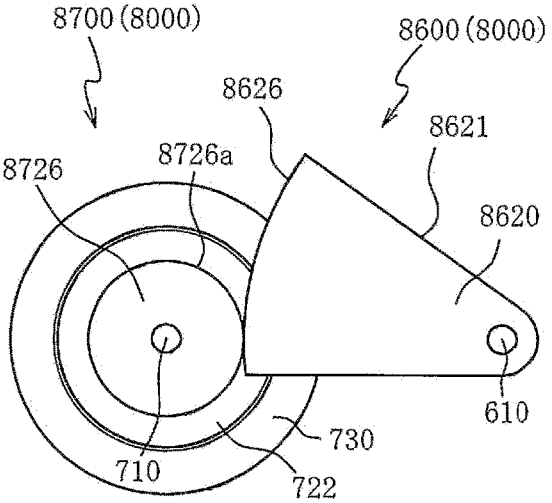
FIG. 9*b* is a side view of a keyboard device according to an eighth embodiment.

FIG. 9*a* is a side view of a keyboard device 7000 according to the seventh embodiment, and FIG. 9*b* is a side view of a keyboard device 8000 according to the eighth embodiment. In order to simplify the drawings, FIGS. 9*a* and 9*b* illustrate only transmission members 7600 and 8600 and the flywheels 7700 and 8700.

As shown in FIG. 9*a*, the keyboard device 7000 includes the transmission member 7600 for transmitting a driving force in response to key touching of a key to the flywheel 7700. The transmission member 7600 includes a main body part 7620 having a fan shape turning around the turning shaft 610, and the upper surface of the main body part 7620 is configured to serve as an abutting surface 7621 of the flat surface.

A driving gear 7625 is formed on the outer circumferential surface around the turning shaft 610 of the main body part 7620, and a driven gear 7725 is fixed to the side surface of the outer wheel 722 of the flywheel 7700. When the abutting surface 7621 is pressurized downward in accordance with key touching of a key, the transmission member 7600 and the flywheel 7700 are interlocked with each other due to the driving gear 7625 and the driven gear 7725 meshing with each other. Therefore, a driving force in response to key touching of a key can be transmitted to the flywheel 7700.

As shown in FIG. 9*b*, the keyboard device 8000 includes a transmission member 8600 for transmitting a driving force in response to key touching of a key to the flywheel 8700. The transmission member 8600 includes a main body part 8620 having a fan shape turning around the turning shaft 610, and the upper surface of the main body part 8620 is configured to serve as an abutting surface 8621 constituted of a flat surface.

The outer circumferential surface around the turning shaft 610 of the main body part 8620 is configured to serve as a driving surface 8626. A cylindrical driven part 8726 is fixed to the side surface of the outer wheel 722 of the flywheel 8700, and the outer circumferential surface of the driven part 8726 is configured to serve as a driven surface 8726*a*.

The driving surface 8626 and the driven surface 8726*a* are disposed in a manner of abutting each other, and the driving surface 8626 and the driven surface 8726*a* are coarsened by being subjected to blast processing or bonding a tape having a high frictional coefficient, for example. Accordingly, when the abutting surface 8621 is pressurized downward in accordance with key touching of a key, the transmission member 8600 and the flywheel 8700 are interlocked with each other due to a frictional force generated between the driving surface 8626 and the driven surface 8726*a*. Thus, a driving force in response to key touching of a key can be transmitted to the flywheel 8700.

In the keyboard devices 7000 and 8000 according to the seventh embodiment and the eighth embodiment, a key touching feeling can be easily changed by changing the number of teeth of the driving gear 7625 and the driven gear 7725 and the frictional coefficient of the driving surface 8626 or the driven surface 8726*a*.

Next, with reference to FIG. 9*c*, a ninth embodiment will be described. In the first embodiment, a case in which the outer circumferential surface of the mass part 730 is magnetized has been described. However, in the ninth embodiment, a penetration hole 9731 is formed on the side surface of a mass part 9730. The same reference signs are applied to the same portions as the first embodiment described above, and description thereof will be omitted.

Figure 9C:
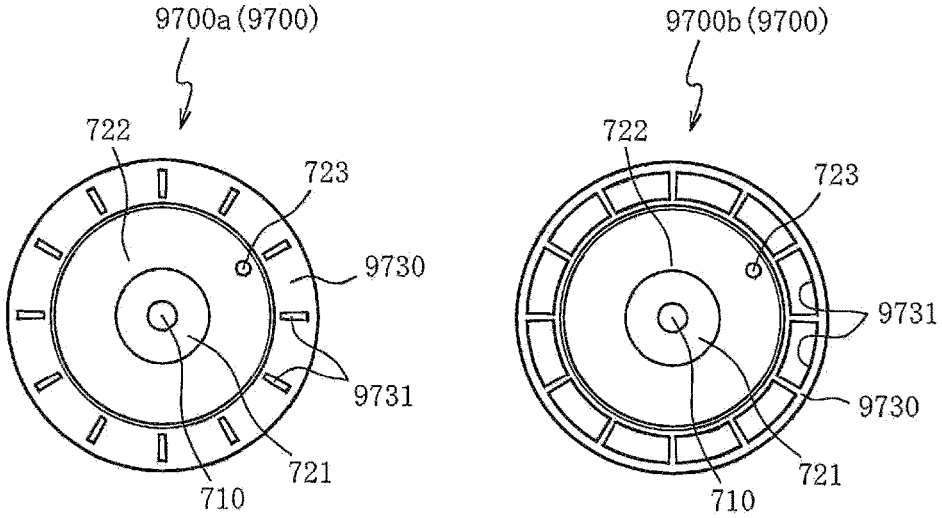
FIG. 9*c* is a side view of a flywheel according to a ninth embodiment.

FIG. 9*c* is a side view of a flywheel 9700 according to the ninth embodiment. In order to simplify the drawing, FIG. 9*c* illustrates only the flywheel 9700.

As shown in FIG. 9*c*, the flywheel 9700 according to the ninth embodiment includes a flywheel 9700*a* installed in a mass body unit of a key on a low tone side, and a flywheel 9700*b* installed in a mass body unit of a key on a high tone side.

A plurality (12 in the present embodiment) of penetration holes 9731 is drilled on the side surface of the mass part 9730 of each of the flywheels 9700*a* and 9700*b* in the circumferential direction. Compared to the penetration hole 9731 of the flywheel 9700*a* on the low tone side, the penetration hole 9731 of the flywheel 9700*b* on the high tone side is formed to have large opening dimensions.

Accordingly, compared to the flywheel 9700*a* on the low tone side, the flywheel 9700*b* on the high tone side has a light weight. In addition, the flywheel 9700 is set to have a weight which gradually becomes lighter from the low tone side to the high tone side (not illustrated). Accordingly, a key touching feeling close to that of an acoustic piano can be applied.

In this manner, when a plurality of penetration holes 9731 (or unevenness) is formed in the mass part 9730 in the circumferential direction, a configuration in which the rotation state (key touching information of a key) of the plurality of penetration holes 9731 (unevenness) is detected by a laser sensor detecting the flywheel 9700 may be adopted.

Hereinabove, description has been given on the basis of the embodiments, but the present disclosure is not limited to the foregoing embodiments in any way, and it is possible to easily imagine that various modifications and changes can be made within a range not departing from the gist of the present disclosure.

In each of the foregoing embodiments, a part or all of the configuration in one embodiment may be combined or replaced with a part or all of the configuration in another embodiment to have a different embodiment.

In each of the foregoing embodiments, a case in which a driving force from a key is transmitted via the transmission member has been described, but the configuration is not necessarily limited thereto. For example, transmission means may be configured by forming a configuration corresponding to the groove part 623 or the protrusion part 723 of the first embodiment in the projection parts of white keys (black keys) or the inner wheel or the outer wheel of the flywheel, and a configuration in which a driving force is directly transmitted to the flywheel from a key may be adopted.

In each of the foregoing embodiments, a case in which each of the transmission member and the flywheel is supported by one case body 800 has been described, but the configuration is not necessarily limited thereto. For example, a configuration in which each of a case body supporting the transmission member and a case body supporting the flywheel is individually provided may be adopted.

In each of the foregoing embodiments, a case in which the stopper parts (the first stopper part and the second stopper part) for braking turning of the mass part of the flywheel and the contact parts (turning curbing means) abutting the mass part of the flywheel at all times is provided at the key touching initial position or the key touching terminal position has been described, but the configuration is not necessarily limited thereto. For example, a configuration in which any of the stopper parts and the contact parts is omitted may be adopted. In addition, the abutting position with respect to the stopper parts or the mass part of the contact parts can be suitably set on the side surface of the mass part, the outer circumferential surface, or the like.

In each of the foregoing embodiments, the coil spring 814 has been illustrated as an example of a biasing member biasing a key (a transmission member), but the configuration is not necessarily limited thereto. For example, naturally, the coil spring 814 can be changed with a different elastic body (for example, a leaf spring).

In each of the foregoing embodiments, a case in which N poles and S poles are alternately magnetized on the outer circumferential surface of the mass part of the flywheel has been described, but the configuration is not necessarily limited thereto. A configuration in which the turning state of the flywheel is detected by a sensor by alternately magnetizing the N poles and the S poles on the side surface of the inner wheel or the outer wheel of the flywheel may be adopted.

In each of the foregoing embodiments, a case in which key touching information of a key is detected by detecting the turning state of the mass part of the flywheel has been described, but the configuration is not necessarily limited thereto. For example, a sensor for detecting the turning state of the inner wheel, a switch coming into contact with a key at the time of key touching, and the like may be provided so that key touching information may be detected using the sensor or the switch.

In the foregoing sixth embodiment, a case in which the groove part is bent in the vicinity of the key touching terminal position has been described, but the configuration is not necessarily limited thereto. For example, various key touching feelings can be applied by combining straight lines or curves and suitably forming an extending direction of the groove part.

In the foregoing ninth embodiment, a case in which the penetration hole 9731 of the flywheel **9700*b* on the high tone side is formed to have large opening dimensions compared to the penetration hole 9731 of the flywheel 9700*a* on the low tone side and the weights of the flywheels 9700*a* and 9700*b*** are changed has been described, but the configuration is not necessarily limited thereto. For example, a configuration in which the weight is changed by changing the thickness of the flywheel may be adopted.

What is claimed is:

1. A keyboard device comprising:

a chassis;

a mass body which is turnably installed in the chassis; and a transmission member which comprises a main body part and transmits a driving force in response to key touching of a key to the mass body, wherein the mass body comprises an inner wheel and an outer wheel installed on a radially outward side of the inner wheel and is configured to serve as a component for transmitting a torque in one-way direction between the inner wheel and the outer wheel, wherein the transmission member is engaged with one of the inner wheel and the outer wheel of the mass body, wherein the torque is transmitted between the inner wheel and the outer wheel of the mass body at a time of key touching, and wherein the torque is not transmitted between the inner wheel and the outer wheel of the mass body at a time of key release.

2. The keyboard device according to claim 1, wherein the transmission member is turnably installed in the chassis with a turning shaft as a turning center, and wherein in the transmission member, a portion engaged with the one of the inner wheel and the outer wheel of the mass body is positioned on a side opposite to the turning shaft with respect to a portion that the key abuts.

3. The keyboard device according to claim 1, wherein engagement between the one of the inner wheel and the outer wheel of the mass body and the transmission member is formed by a groove part having a groove shape and a projection part which slides along a groove of the groove part, and wherein a gap is formed between a terminal of the groove part and the projection part in a state in which the key is disposed at a key touching initial position and a key touching terminal position.

4. The keyboard device according to claim 1, wherein engagement between the one of the inner wheel and the outer wheel of the mass body and the transmission member is formed by a groove part having a groove shape and a projection part which slides along a groove of the groove part, and wherein the groove part comprises a transmission region in which a driving force in response to key touching of the key is transmitted to the one of the inner wheel and the outer wheel of the mass body and a non-transmission region in which a driving force in response to key touching of the key is not transmitted to the one of the inner wheel and the outer wheel of the mass body.

5. The keyboard device according to claim 1 further comprising:

a mass body unit in which the mass body, the transmission member, and a support member turnably supporting the mass body and the transmission member are unitized, wherein the mass body unit in a unitized state is installed in a manner of being attachable and detachable with respect to the chassis.

6. The keyboard device according to claim 1, wherein the key comprises a first stopper abutting an outer circumferential surface of the mass body at a key touching terminal position.

7. The keyboard device according to claim 6, wherein the first stopper is installed in the key in a manner of facing the outer circumferential surface of the mass body with an adjustable interval therebetween.

8. The keyboard device according to claim 1, wherein the transmission member comprises a second stopper restricting turning of the other one of the inner wheel and the outer wheel of the mass body at a key touching initial position of the key.

9. The keyboard device according to claim 1, wherein the key and the transmission member are not engaged with each other, and wherein the keyboard device further comprises a biasing member which biases the transmission member in a direction in which the key returns to a key touching initial position.

10. The keyboard device according to claim 1 further comprising:

turning restricting means which comprises a contact part and restricts turning of the other one of the inner wheel and the outer wheel of the mass body.

11. The keyboard device according to claim 1 further comprising:

a sensor which detects a rotation state of the mass body.

12. The keyboard device according to claim 2, wherein engagement between the one of the inner wheel and the outer wheel of the mass body and the transmission member is formed by a groove part having a groove shape and a projection part which slides along a groove of the groove part, and wherein a gap is formed between a terminal of the groove part and the projection part in a state in which the key is disposed at a key touching initial position and a key touching terminal position.

13. The keyboard device according to claim 2, wherein engagement between the one of the inner wheel and the outer wheel of the mass body and the transmission member is formed by a groove part having a groove shape and a projection part which slides along a groove of the groove part, and wherein the groove part comprises a transmission region in which a driving force in response to key touching of the key is transmitted to the one of the inner wheel and the outer wheel of the mass body and a non-transmission region in which a driving force in response to key touching of the key is not transmitted to the one of the inner wheel and the outer wheel of the mass body.

14. The keyboard device according to claim 3, wherein engagement between the one of the inner wheel and the outer wheel of the mass body and the transmission member is formed by a groove part having a groove shape and a projection part which slides along a groove of the groove part, and wherein the groove part comprises a transmission region in which a driving force in response to key touching of the key is transmitted to the one of the inner wheel and the outer wheel of the mass body and a non-transmission region in which a driving force in response to key touching of the key is not transmitted to the one of the inner wheel and the outer wheel of the mass body.

15. A method for detecting key touching information in a keyboard device, the method comprising:

transmitting a driving force in response to key touching of a key using a transmission member comprising a main body part to a mass body which is disk-shaped and turnably installed in a chassis; and detecting key touching information by a sensor through detecting a rotation state of the mass body which is turned by the transmitted driving force.

16. The method according to claim 15, wherein detecting the key touching information comprising alternately magnetizing N and S poles throughout an entire circumference of an outer circumferential surface of the mass body and detecting the rotation state of the mass body through detecting a change in magnetic field in accordance with turning of the mass body.

17. The method according to claim 15, wherein transmitting the driving force comprising:

configuring the mass body by providing an inner wheel and an outer wheel installed on a radially outward side of the inner wheel;

transmitting a torque in one-way direction between the inner wheel and the outer wheel; and engaging one of the inner wheel and the outer wheel, and wherein the torque is transmitted between the inner wheel and the outer wheel of the mass body at a time of key touching, and wherein the torque is not transmitted between the inner wheel and the outer wheel of the mass body at a time of key release.

18. A method for applying a key touching feeling in a keyboard device, the method comprising:

transmitting a driving force in response to key touching of a key using a transmission member comprising a main body part to a mass body which is turnably installed in a chassis; and a key touching feeling applying step turning the mass body by the transmitted driving force and applying a key touching feeling due to a torque in accordance with the turning of the mass body, wherein the mass body in the key touching feeling applying step comprises an inner wheel and an outer wheel installed on a radially outward side of the inner wheel and is configured to serve as a component for transmitting a torque in one-way direction between the inner wheel and the outer wheel, wherein the transmission member is engaged with one of the inner wheel and the outer wheel of the mass body, and wherein in the key touching feeling applying step, the torque is transmitted between the inner wheel and the outer wheel of the mass body at a time of key touching and the torque is not transmitted between the inner wheel and the outer wheel of the mass body at a time of key release.

19. The method according to claim 18, wherein engagement between the one of the inner wheel and the outer wheel of the mass body and the transmission member is formed with following steps comprising:

providing a groove part having a groove shape in the transmission member;

providing a projection part which slides along a groove of the groove part on the one of the inner wheel and the outer wheel, and forming the engagement by the groove part and the projection part.

20. The method according to claim 19, wherein a gap is formed between a terminal of the groove part and the projection part in a state in which the key is disposed at a key touching initial position and a key touching terminal position.

* * * * *